US009351532B2

(12) United States Patent
Mokos

(10) Patent No.: US 9,351,532 B2
(45) Date of Patent: May 31, 2016

(54) ARTICLE OF FOOTWEAR INCLUDING UPPER HAVING A MESH MATERIAL

(75) Inventor: Jeffrey J. Mokos, Boston, MA (US)

(73) Assignee: Converse, Inc., Boston, MA (US)

( * ) Notice: Subject to any disclaimer, the term of this patent is extended or adjusted under 35 U.S.C. 154(b) by 450 days.

(21) Appl. No.: 13/342,187

(22) Filed: Jan. 2, 2012

(65) Prior Publication Data

US 2013/0055590 A1 Mar. 7, 2013

Related U.S. Application Data

(63) Continuation-in-part of application No. 29/401,070, filed on Sep. 6, 2011, now Pat. No. Des. 651,391.

(51) Int. Cl.

| | |
|---|---|
| ***A43B 23/02*** | (2006.01) |
| ***A43B 13/18*** | (2006.01) |
| ***A43B 1/04*** | (2006.01) |

(52) U.S. Cl.

CPC ..... *A43B 1/04* (2013.01); *A43B 23/0205* (2013.01); *A43B 23/0235* (2013.01); *A43B 23/0245* (2013.01); *A43B 23/0265* (2013.01)

(58) Field of Classification Search

CPC ..... A43B 23/0225; A43B 23/022; A43B 23/0235; A43B 23/025; A43B 23/027; A43B 23/0275

USPC ..... 36/45, 28

See application file for complete search history.

(56) References Cited

U.S. PATENT DOCUMENTS

| | | | |
|---|---|---|---|
| D13,864 | S | 4/1883 | Savage |
| D61,583 | S | 10/1922 | Lord |
| D61,586 | S | 10/1922 | Lord |
| D61,833 | S | 1/1923 | Lord |
| 2,001,962 | A | 5/1935 | Kantrow |
| D97,136 | S | 10/1935 | Kilborne |
| D121,324 | S | 7/1940 | Landry |
| D121,668 | S | 7/1940 | Bry et al. |
| D128,106 | S | 7/1941 | Cummings |

(Continued)

FOREIGN PATENT DOCUMENTS

| | | | |
|---|---|---|---|
| CN | 101077234 | A | 11/2007 |
| CN | 201468180 | U | 5/2010 |

(Continued)

OTHER PUBLICATIONS

Spring 2010 Converse Product Catalog, All Star 2 strap Hi, p. 15, All Star Hi, p. 18, and All Star Print Hi, p. 22.

(Continued)

*Primary Examiner* — Robert J Hicks
*Assistant Examiner* — Timothy K Trieu
(74) *Attorney, Agent, or Firm* — Shook, Hardy & Bacon L.L.P.

(57) ABSTRACT

An article of footwear includes include an upper and a mesh material. The mesh material may be incorporated into the upper. The mesh material may include high tensile strength strands and non-high tensile strength strands. The high tensile strength strands and non-high tensile strength strands may interlock so that the high tensile strength strands are substantially held in place. The mesh material may be provided as a woven material or a knitted material. The mesh material can have a stylish design, which can be a plaid pattern, herringbone pattern, seersucker pattern, or other pattern.

8 Claims, 27 Drawing Sheets

(56) References Cited

U.S. PATENT DOCUMENTS

| | | | | |
|---|---|---|---|---|
| D143,675 | S | 1/1946 | Smith | |
| D166,645 | S | 4/1953 | Usdin | |
| D170,782 | S | 11/1953 | Wegner | |
| D173,699 | S | 12/1954 | Hosker | |
| D238,218 | S | 12/1975 | Cohn | |
| D238,219 | S | 12/1975 | Cohn | |
| D266,968 | S | 11/1982 | Railton | |
| 4,438,574 | A * | 3/1984 | Johnson | 36/45 |
| D448,149 | S | 9/2001 | Matis et al. | |
| D461,628 | S | 8/2002 | Neely et al. | |
| D471,350 | S | 3/2003 | Roulo | |
| D490,231 | S | 5/2004 | Estey | |
| D493,028 | S | 7/2004 | Len | |
| D493,951 | S | 8/2004 | Adams et al. | |
| D494,345 | S | 8/2004 | Werman | |
| D524,518 | S | 7/2006 | James | |
| D544,700 | S | 6/2007 | Link | |
| D553,340 | S | 10/2007 | Dirsa | |
| D555,348 | S | 11/2007 | Bettencourt | |
| D576,380 | S | 9/2008 | Morris | |
| 7,444,768 | B2 | 11/2008 | Friton | |
| D594,636 | S | 6/2009 | Del Biondi et al. | |
| D595,039 | S | 6/2009 | Matis | |
| 7,754,626 | B2 | 7/2010 | Baron et al. | |
| 7,770,307 | B2 | 8/2010 | Meschter | |
| 7,774,956 | B2 * | 8/2010 | Dua et al. | 36/50.1 |
| 8,132,340 | B2 | 3/2012 | Meschter | |
| 8,490,299 | B2 * | 7/2013 | Dua et al. | 36/50.1 |
| 2005/0178026 | A1 | 8/2005 | Friton | |
| 2006/0048413 | A1 | 3/2006 | Sokolowski et al. | |
| 2006/0207124 | A1 | 9/2006 | Dana | |
| 2008/0022554 | A1 * | 1/2008 | Meschter et al. | 36/45 |
| 2010/0018075 | A1 | 1/2010 | Meschter et al. | |
| 2010/0037483 | A1 | 2/2010 | Meschter et al. | |
| 2010/0043253 | A1 | 2/2010 | Dojan et al. | |
| 2010/0199406 | A1 * | 8/2010 | Dua et al. | 2/115 |
| 2010/0199520 | A1 * | 8/2010 | Dua et al. | 36/87 |
| 2010/0251491 | A1 | 10/2010 | Dojan et al. | |
| 2010/0251564 | A1 | 10/2010 | Meschter | |
| 2011/0041359 | A1 | 2/2011 | Dojan et al. | |
| 2012/0023778 | A1 | 2/2012 | Dojan et al. | |
| 2012/0055044 | A1 | 3/2012 | Dojan et al. | |

FOREIGN PATENT DOCUMENTS

| | | |
|---|---|---|
| EP | 0090580 A1 | 10/1983 |
| WO | 2011028444 | 3/2011 |

OTHER PUBLICATIONS

Spring 2010 Converse Jack Purcell Product Catalog, Jack Purcell LTT OX, p. 9.

Spring 2010 Converse John Varvatos Product Catalog, Jack Purcell Vintage OX, p. 7.

Summer 2009 Metro Converse Product Catalog, Jack Purcell LTT OX.

Fall 2008 Converse Product Catalog, Chuck Taylor Grunge Plaid Hi.

Summer 2008 Converse Product Catalog, Vacation, Models 304372F, 304637F, 304596F, 304631, and 704621.

Summer 2008 Converse Metro Product, and Jack Purcell Specialty Slip, Models 104274, and 104272, p. 6.

Spring 2008 Converse Product Catalog, Buffalo Check Plaid, p. 50, and Ombre Plaid, p. 57.

Holiday 2007 Converse Product Catalog, Model 101886F, p. 42, and Model 101903F, p. 44.

Spring 2007 Converse Product Catalog, Grandpa Plaid, Model IY018, and IY017.

Spring 2007 Hurley Footwear Catalog, Trips 9 Lowrider, Model 50211HUR, p. 6.

Spring 2005 Converse Product Catalog, Chuck Taylor All Star Print Ox, Models IS183, 1S187, 1S184, and 1S182, p. 7.

Notification of Transmittal of the International Search Report and the Written Opinion of the International Searching Authority mailed Nov. 28, 2012 for PCT Application No. PCT/US2012/027705.

European Extended Search Report dated Sep. 21, 2015 in Application No. 12864273.3, 7 pages.

* cited by examiner

ARTICLE OF FOOTWEAR INCLUDING UPPER HAVING A MESH MATERIAL

This application is a continuation-in-part and claims priority under 35 U.S.C. §120 to U.S. patent application Ser. No. 29/401,070, which was filed in the U.S. Patent and Trademark Office on Sep. 6, 2011, such prior U.S. Patent Application being entirely incorporated herein by reference.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void in the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart different properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. One of the challenges with designing athletic footwear is to provide a designer with freedom of design to combine various materials for an upper to achieve a desired appearance while minimizing the weight of the upper. Although numerous materials could be combined and used to provide a desired design, the design could result in a heavier upper, which may diminish mobility, performance, and comfort for a wearer.

The time and expense associated with transporting, stocking, cutting, and joining material elements may also increase as the number of material elements of an upper increases. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

In view of these considerations, there is a need for an article of footwear that advantageously includes a strong, lightweight structure that also provides a designer with a substantial degree of design freedom when creating an article of footwear with a stylish design.

SUMMARY

Various aspects of an article of footwear are disclosed below.

According to an embodiment, an article of footwear may include an upper and a mesh material. The mesh material may be incorporated into the upper. The mesh material may include high tensile strength strands and non-high tensile strength strands. The high tensile strength strands and non-high tensile strength strands may interlock so that the high tensile strength strands are substantially held in place.

According to an embodiment, an article of footwear may include an upper that includes a mesh. The mesh may include high tensile strength strands and non-high tensile strength strands. The non-high tensile strength strands may substantially hold the high tensile strength strands in place. The mesh may have a plaid pattern.

According to an embodiment, an article of footwear may include an upper that includes a mesh. The mesh may include high tensile strength strands and non-high tensile strength strands. The non-high tensile strength strands may substantially hold the high tensile strength strands in place. The mesh may have a herringbone pattern.

According to an embodiment, an article of footwear may include an upper that includes a mesh. The mesh may include high tensile strength strands and non-high tensile strength strands. The non-high tensile strength strands may substantially hold the high tensile strength strands in place. The mesh may have a seersucker pattern.

BRIEF DESCRIPTION OF THE DRAWINGS

The foregoing Summary and the following Detailed Description will be better understood when read in conjunction with the accompanying figures.

DETAILED DESCRIPTION

Figure 1:
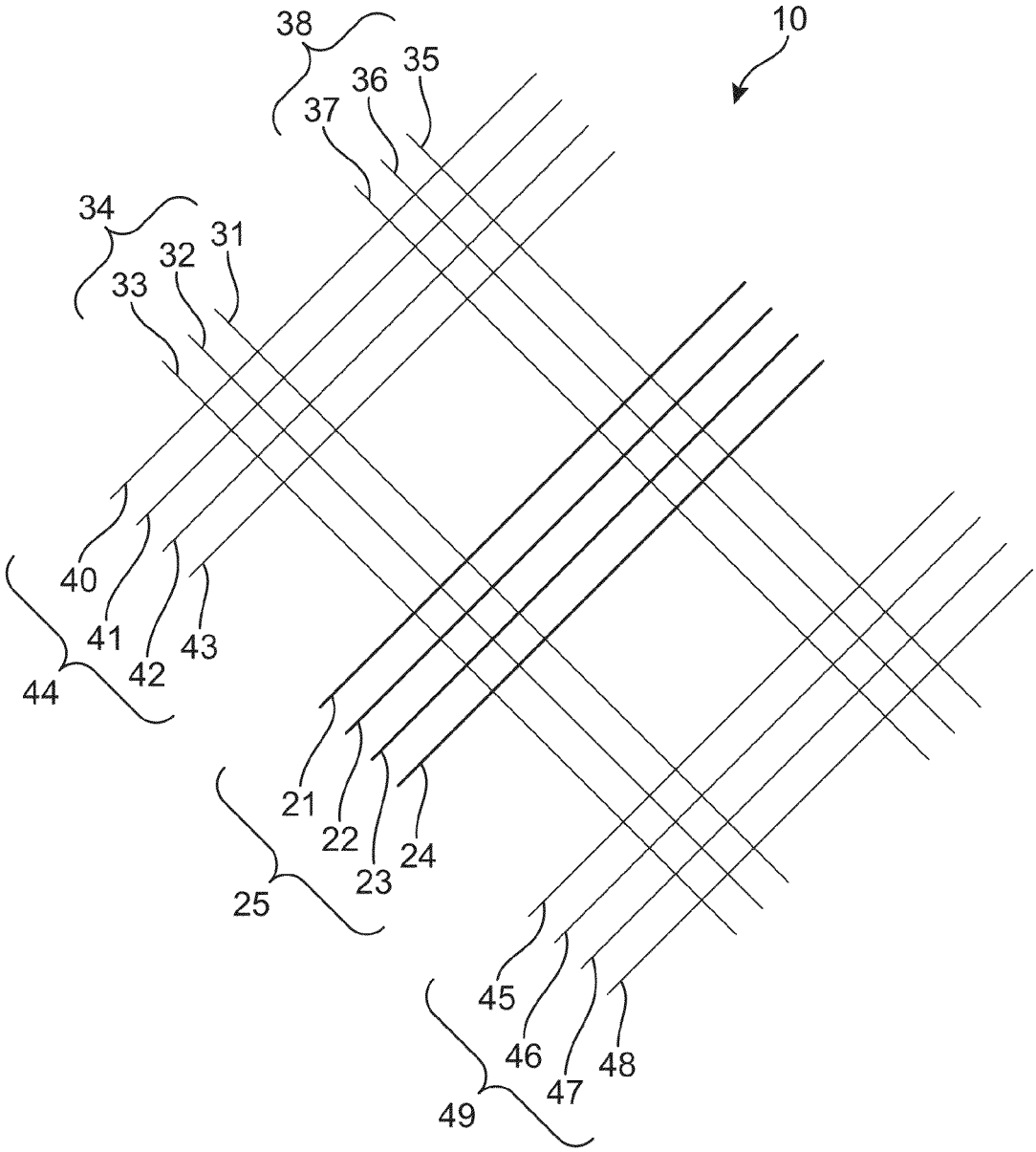
FIG. 1 is an isometric view of a mesh including strands, according to an embodiment.

The following discussion and accompanying figures disclose an article of footwear having an upper that includes a mesh material. The mesh material may include tensile strand elements. The article of footwear is disclosed as having a general configuration suitable for a variety of pursuits. Concepts associated with the footwear, including the upper, may also be applied to a variety of other athletic footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types. The mesh material may, however, be utilized in a variety of other products, including backpacks and other bags and apparel (e.g., pants, shirts, headwear), for example. Accordingly, the concepts disclosed herein may apply to a wide variety of products.

A conventional upper may be formed from multiple material layers that each may impart different properties to various areas of the upper. During use, an upper may experience significant tensile forces, and one or more layers of material are positioned in areas of the upper to resist the tensile forces. That is, individual layers may be incorporated into specific portions of the upper to resist tensile forces that arise during use of the footwear. As an example, a textile may be incorporated into an upper to impart stretch resistance in the longitudinal direction. Such a textile may be, for example, a woven textile formed from yarns that interweave at right angles to each other. If the woven textile is incorporated into the upper for purposes of longitudinal stretch-resistance, then only the yarns oriented in the longitudinal direction will contribute to longitudinal stretch-resistance, and the yarns oriented orthogonal to the longitudinal direction will not generally contribute to longitudinal stretch-resistance. As a result, approximately one-half of the yarns in the woven textile are superfluous to longitudinal stretch-resistance.

As an extension of this example, the degree of stretch-resistance required in different areas of an upper may vary. Whereas some areas of the upper may require a relatively high degree of stretch-resistance due to forces that the areas are subjected to, other areas of the upper may require a relatively low degree of stretch-resistance. Because the woven textile may be utilized in areas requiring both high and low degrees of stretch-resistance, some of the yarns in the woven textile may be superfluous in areas requiring the low degree of stretch-resistance. In this example, the superfluous yarns add to the overall mass of the footwear, without adding beneficial properties to the footwear. Similar concepts apply to other materials, such as leather and polymer sheets, that are utilized for one or more of wear-resistance, flexibility, air-permeability, cushioning, and moisture-wicking, for example.

Based upon the above discussion, materials utilized in a conventional upper formed from multiple layers of material may have superfluous portions that do not significantly contribute to the desired properties of the upper but add to the overall weight of an article of footwear. With regard to stretch-resistance, for example, a layer may have material that imparts (a) a greater number of directions of stretch resistance or (b) a greater degree of stretch-resistance than is necessary or desired. The superfluous portions of these materials may, therefore, add to the overall mass of the footwear without contributing beneficial properties.

One method of addressing these issues has been to incorporate tensile strand elements into an upper to provide strength and stretch resistance to the upper. The use of such tensile strand elements is discussed in, for example, U.S. application Ser. No. 12/362,371, filed on Jan. 29, 2009; U.S. application Ser. No. 12/419,985, filed on Apr. 7, 2009; U.S. application Ser. No. 12/419,987, filed on Apr. 7, 2009; U.S. application Ser. No. 12/546,017, filed on Aug. 24, 2009; U.S. application Ser. No. 12/546,019, filed on Aug. 24, 2009; U.S. application Ser. No. 12/546,022, filed on Aug. 24, 2009; U.S. application Ser. No. 12/847,836, filed on Jul. 30, 2010; and U.S. application Ser. No. 13/196,365, filed on Aug. 2, 2011, which are each hereby incorporated by reference in their entireties.

Figure 24:
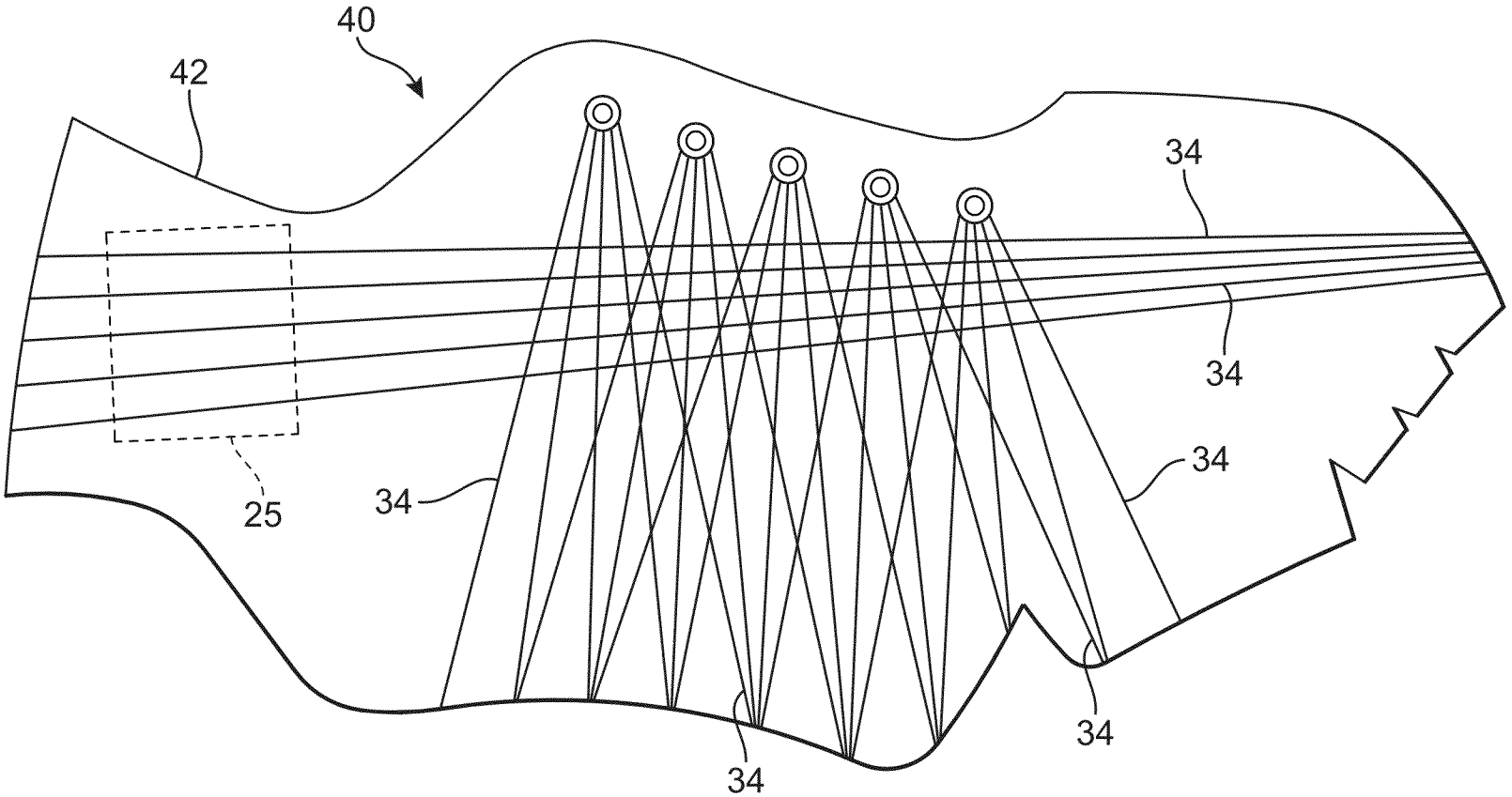
FIG. 24 is a side view of a conventional tensile strand element, according to an embodiment.

A conventional tensile strand element includes strands having a relatively high tensile strength. Turning to the example of FIG. 24, a conventional tensile strand element 40 can include strands 34 having a relatively high tensile strength that enhance the stretch resistance of strand element 40. A tensile strand element 40 can be incorporated into the layers of an upper to enhance strength and impart stretch resistance of the upper, while using less material due to the elongated and relatively narrow shape of the tensile strand elements.

Figure 25:
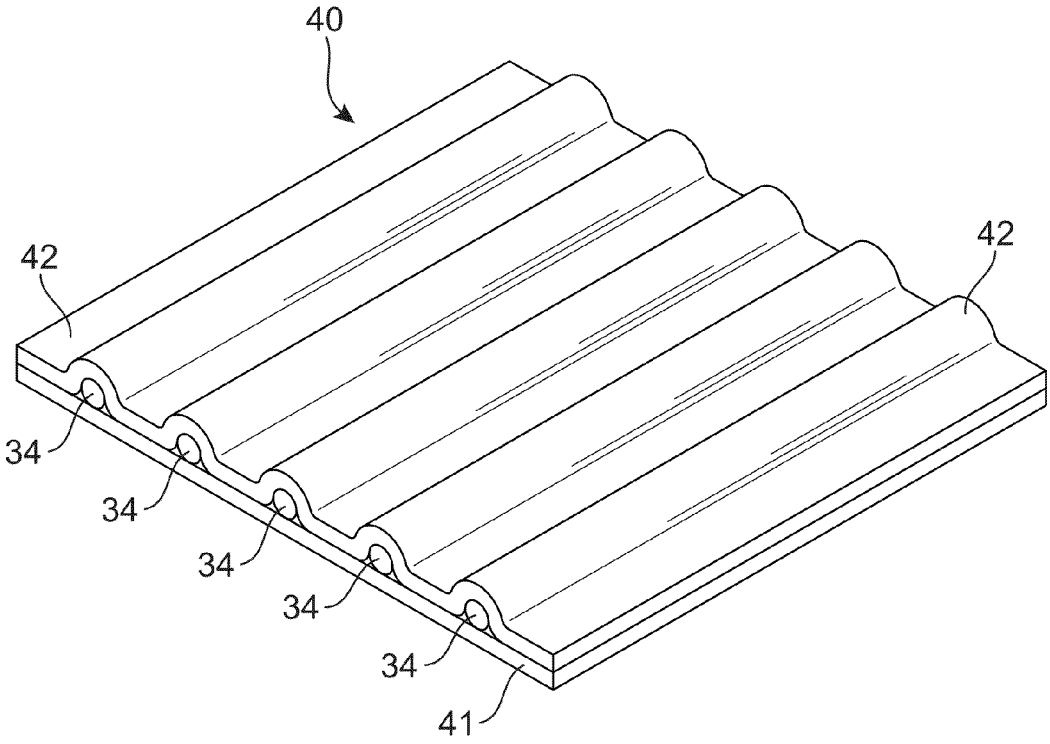
FIG. 25 is an isometric view of enlarged area 25 of tensile strand element of FIG. 24.
Figure 26:
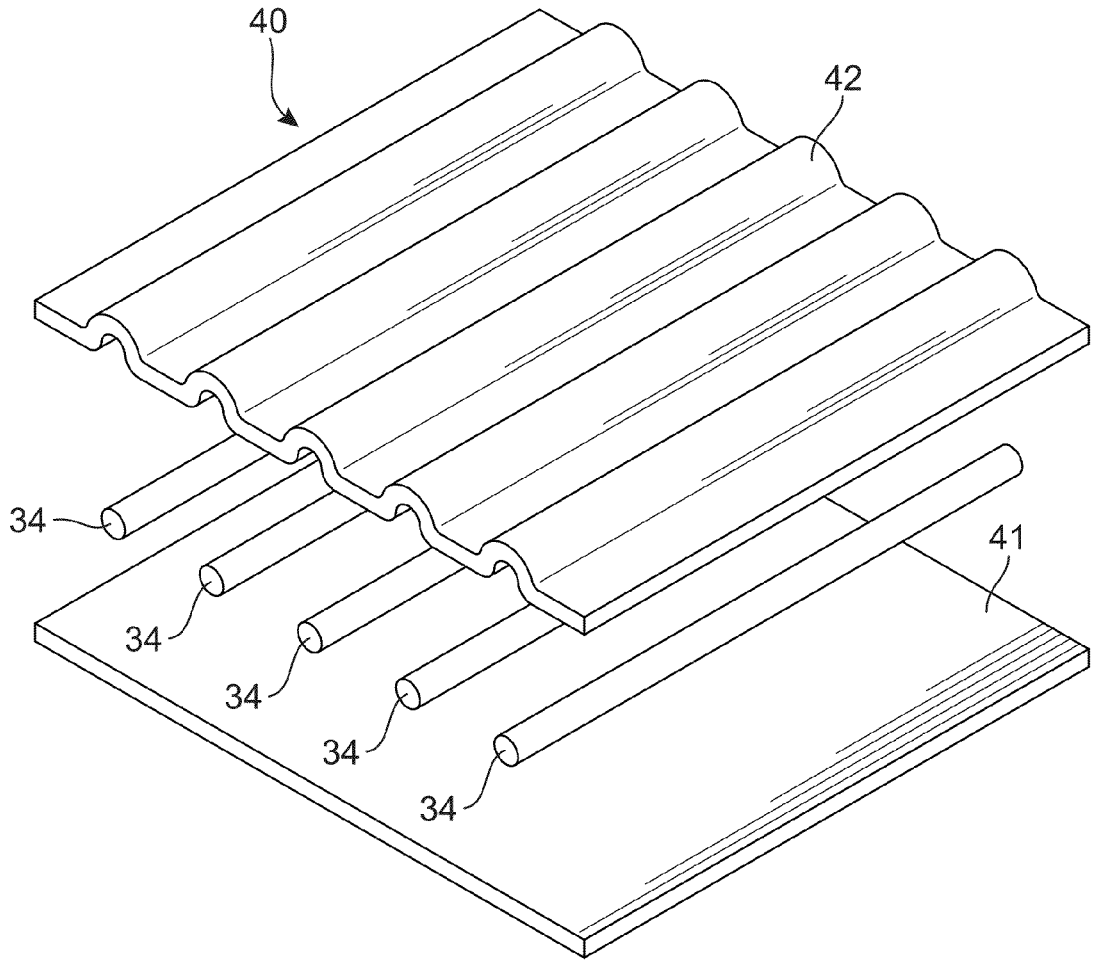
FIG. 26 is an exploded view the tensile strand element of FIG. 25.

To maintain the position of the strands, a conventional tensile strand element may position the strands between two materials, covers, or layers which act to hold the strands in place. Examples of such materials, covers, or layers are discussed in, for example, U.S. application Ser. No. 12/362,371, filed on Jan. 29, 2009; U.S. application Ser. No. 12/419,985, filed on Apr. 7, 2009; U.S. application Ser. No. 12/419,987, filed on Apr. 7, 2009; U.S. application Ser. No. 12/546,017, filed on Aug. 24, 2009; U.S. application Ser. No. 12/546,019, filed on Aug. 24, 2009; U.S. application Ser. No. 12/546,022, filed on Aug. 24, 2009; U.S. application Ser. No. 12/847,836, filed on Jul. 30, 2010; and U.S. application Ser. No. 13/196,365, filed on Aug. 2, 2011, which are each hereby incorporated by reference in their entireties. Turning to FIG. 25, which is enlarged view of area 25 of the tensile strand element 40 of FIG. 24, a tensile strand element 40 may include a base layer 41 and a cover layer 42, with strands 34 being positioned between base layer 41 and cover layer 42. FIG. 26 shows an exploded view of the embodiment of FIG. 25 and further illustrates how strands 34 are positioned between base layer 41 and cover layer 42. Strands 34 can extend parallel to surfaces of base layer 41 and cover layer 42. By being substantially parallel to the surfaces of base layer 41 and cover layer 42, strands 34 resist stretch in directions that correspond with the surfaces of base layer 41 and cover layer 42.

Strands 34 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for strands 34 include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Such materials may provide a relatively high tensile strength which enhances the stretch resistance of a material that a strand 34 is incorporated into. Whereas filaments have an indefinite length and may be utilized individually as strands 34, fibers have a relatively short length and generally go through spinning or twisting processes to produce a strand of suitable length.

An individual filament utilized in strands 34 may be formed from a single material (i.e., a monocomponent filament) or from multiple materials (i.e., a bicomponent filament). Similarly, different filaments may be formed from different materials. As an example, yarns utilized as strands 34 may include filaments that are each formed from a common material, may include filaments that are each formed from two or more different materials, or may include filaments that are each formed from two or more different materials. Similar concepts also apply to threads, cables, or ropes. The thickness of strands 34 may also vary significantly to range from, for example, 0.03 millimeters to more than 5 millimeters. Although one-dimensional materials may often have a cross-section where width and thickness are substantially equal (e.g., a round or square cross-section), some one-dimensional materials may have a width that is greater than a thickness (e.g., a rectangular, oval, or otherwise elongate cross-section).

Strands may be utilized to modify properties of an article of footwear other than stretch-resistance. For example, strands may be utilized to provide additional wear-resistance in specific areas of an upper. For example, strands may be concentrated in areas of upper that experience wear, such as in a forefoot region of the upper and adjacent to a sole structure. If utilized for wear resistance, strands may be selected from materials that exhibit relatively high wear-resistance properties. Strands may also be utilized to modify the flex characteristics of an upper. For example, areas with relatively high concentrations of strands may flex to a lesser degree than areas with relatively low concentrations of strands. Similarly, areas with relatively high concentrations of strands may be less air permeable than areas with relatively low concentrations of strands. Further, strands may be used to connect or affix an upper to a sole structure while using less weight than a conventional upper which uses, for example, leather or other textile panels connected to a sole structure. Strands may also strength such a connection between an upper and sole structure.

The sole structure can be secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

In conventional designs, tensile strand elements may be provided as separate elements, such as separate filaments, yarns, or strands, that were placed on top of a base layer of the upper. To ensure that the tensile strand elements remained in place, a connecting layer or other securing element may bond, secure, or otherwise join the tensile strand elements to the base layer. According to one example, a sheet of thermoplastic polymer could be located between strands and the base layer and heated to bond the strands and base layer together. According to another example, the connecting element or securing element may be a sheet of thermoplastic polymer or a textile, for example, that extended over strands and the base layer to bond the strands and the base layer together. Such a sheet can in turn act as a cover layer that forms a portion of an exterior or exposed surface of the upper, with a combination of the base layer, strands, and the cover sheet providing substantially all of the thickness of the upper in some areas. In another example, connecting element or other securing element may be an adhesive that bonds strands and the base layer together. In other examples, additional individual threads are stitched over strands to secure the tensile strand elements to the base layer. As a result, a variety of structures or methods may be used to secure strands to an underlying base layer.

Although conventional tensile strand elements provide a high degree of performance, such as by enhancing the stretch resistance of an upper, the methods used to incorporate the tensile strand elements into an upper may provide an article of footwear that is stylish and pleasing for certain uses. For example, by incorporating strands 34 between a base layer 41 and a cover layer 42, an article of footwear is produced with high performance and a style for athletic use but not necessarily for casual use. It would be desirable to provide an article of footwear which provides a high level of performance but is also stylish and pleasing for multiple uses, such as both athletic and casual uses.

According to an embodiment, strands may be incorporated into a mesh material. The mesh material may include a combination of high tensile strength stands and non-high tensile strength stands that do not possess a high tensile strength. For example, the strands not possessing high tensile strength may intersect the high tensile strength strands. A mesh including a pattern of intersecting strands can advantageously provide a structure that substantially holds the high tensile strength strands in place while also providing enhance performance. As a result, the mesh material could include high tensile strength strands which enhance the strength and stretch resistance of the mesh but do not require a base layer and a cover layer to maintain the position of the high tensile strength strands. Such a mesh may advantageously be breathable and flexible but also have relatively high strength and limited stretch. Besides advantageously providing enhanced performance and materials savings, the mesh material may also provide a stylish pattern FIG. 1 shows a mesh 10 which includes a first set 25 of high tensile strength strands. According to an embodiment, first set 25 of tensile strength strands can include various numbers of tensile strength strands. The number of tensile strength strands selected for a given set of high tensile strength strands may be selected, for example, according to a desired strength and/or stretch resistance for mesh 10. For example, first set 25 of high tensile strength strands can include a first high tensile strength strand 21, a second high tensile strength strand 22, a third high tensile strength strand 23, and a fourth high tensile strength strand 24, although first set 25 of tensile strength strands can include other numbers of high tensile strength strand. High tensile strength strands can be in the same form as strands 34 used in a conventional tensile strand element 40 discussed above and can be made from the same materials. For example, high tensile strength strands of first set 25 may be high tensile strength nylon. First set 25 of high tensile strength strands may act to increase the strength of mesh 10 and enhance the stretch resistance of mesh 10 due to the tensile properties of the high tensile strength strands.

Mesh 10 may include a second set 34 of strands which intersect the first set 25 of high tensile strength strands. According to an embodiment, second set 34 of strands can include various numbers of strands. The number of strands selected for second set 34 of strands may be selected, for example, to provide a sufficient number of strands to intersect with high tensile strength strands and substantially hold the high tensile strength strands in place. For example, second set 34 may include a first strand 31, a second strand 32, and a third strand 33, although second set 34 can include other numbers of strands.

Strands of the second set 34 of strands can be non-high tensile strength strands. For example, strands of second set 34 may be in a different form and/or be made from different materials than high tensile strength strands of first set 25. For example, non-high tensile strength strands, such as the strands of second set 34, may be made of polyester. In another example, non-high tensile strength strands can be made of a mixture of 60% polyester & 40% polyester 150D. In another example, when mesh 10 includes high tensile strength strands and non-high tensile strength strands, mesh 10 can be made of various materials, which may be selected according to a desired strength and stretch resistance for mesh 10.

The strands of second set 34 do not necessarily enhance the strength and stretch resistance of mesh 10 to the degree that high tensile strength strands do. However, strands of second set 34 may intersect high tensile strength strands of first set 25 and provide a mesh structure that substantially holds the high tensile strength strands of first set 25 in place. For example, strands of second set 34 may form an interlocking mesh structure with high tensile strength strands of first set 25 that limits movement of the high tensile strength strands of first set 25.

According to an embodiment, mesh 10 may include a plurality of sets of strands. For example, mesh 10 may include first set 25 of high tensile strength strands and at least second set 34 of strands that intersect the high tensile strength strands of first set 25. In another example, mesh 10 may include multiple sets of strands that intersect high tensile strength strands of first set 25, such as second set 34 of strands and a third set 38 of strands. Third set 38 of strands may be substantially the same or similar to those of second set 34. For example, third set 38 may include a first strand 35, a second strand 36, and a third strand 37, although third set 38 may include any number of strands. According to an example, second set 34 of strands and third set of strands may be repeated in any number along a direction that extends along a length of high tensile strength strands of first set 25. This would result in multiple sets of strands intersecting the high tensile strength strands of first set 25 so that the multiple sets of strands act to substantially hold the high tensile strength strands of first set 25 in place.

According to an embodiment, mesh 10 may include additional sets of strands extending in substantially the same direction as first set 25 of strands. For example, mesh 10 may include a fourth set 44 of strands and a fifth set 49 of strands. Fourth set 44 of strands and fifth set 49 of strands may include any number of strands. For example, fourth set 44 of strands may include a first strand 40, a second strand 41, a third strand 42, and a fourth strand 43, and fifth set 49 of strands may include a first strand 45, a second strand 46, a third strand 47, and a fourth strand 48, although fourth set 44 of strands and fifth set 49 of strands may include any number of strands. According to an embodiment, the strands of the fourth set 44 and the strands of the fifth set 49 may be strands like those of second set 34. In such an embodiment, the strands of the fourth set 44, fifth set 49, and second set 34 would be made of the same materials and have the same structure, with the strands of the fourth set 44 and the strands of the fifth set 49 intersecting the strands of the second set 34 to form a mesh structure for mesh 10.

According to an embodiment, a repeating pattern can be provided in which sets of high tensile strength strands alternate with sets of non-high tensile strength strands. For example, the strands of fourth set 44 and fifth set 49 may be non-high tensile strength strands on either side of first set 25 of high tensile strength strands, with sets of high tensile strength strands and sets of non-high tensile strength strands alternating in directions substantially perpendicular to the longitudinal axes of the strands. According to another embodiment, strands of either or both of fourth set 44 and fifth set 49 can be high tensile strength strands substantially the same or similar to those of first set 25. Sets of strands can be selected to include high tensile strength strands or non-high tensile strength strands according to a desired strength and stretch resistance for mesh 10.

According to an embodiment, any of the sets of strands may include a mixture of high tensile strength strands and non-high tensile strength strands. Such a mixture may be selected according to a desired strength and stretch resistance for mesh 10.

According to an embodiment, mesh 10 can be formed from monofilament strands. For example, non-high tensile strength strands can be formed with monofilament strands, such as the strands of second set 34 and other sets including non-high tensile strength strands.

Mesh 10 may be a woven material or a knit material. For example, mesh 10 can be produced as a woven or knit material to not only provide a high performance material with strength and stretch resistance, but to also provide a mesh material having a desired pattern or style.

According to an embodiment, mesh 10 may be a woven material in which strands alternately pass over and under one another in warp and weft directions. For instance, high tensile strength strands of first set 25 may extend in a warp direction while strands of second set 34 may extend in the weft direction. The strands of second set 34, for example, could alternately pass over and under the high tensile strength strands of first set 25 as the strands of second set 34 intersect the high tensile strength strands of first set 25. Such a pattern of weaving strands may provide both high tensile strength strands to enhance the strength and stretch resistance of a mesh material and non-high tensile strength strands to interlock with the high tensile strength strands and substantially hold the high tensile strength strands in place.

According to another embodiment, mesh 10 may be a knit material in which strands are knitted together. For instance, high tensile strength strands of first set 25 may extend in a first direction along their respective lengths and non-high tensile strength strands of second set 34 may interest the high tensile strength strands and knit adjacent high tensile strength strands of first set 25 to one another. For example, non-high tensile strength strands of second set 34 can be formed in loops between first strand 21 and second strand 22 of first set 25 that knit first strand 21 and second strand 22 together. Non-high tensile strength strands can similarly knit other high tensile strength strands to one another and may connect adjacent sets of strands to one another.

Figure 2:
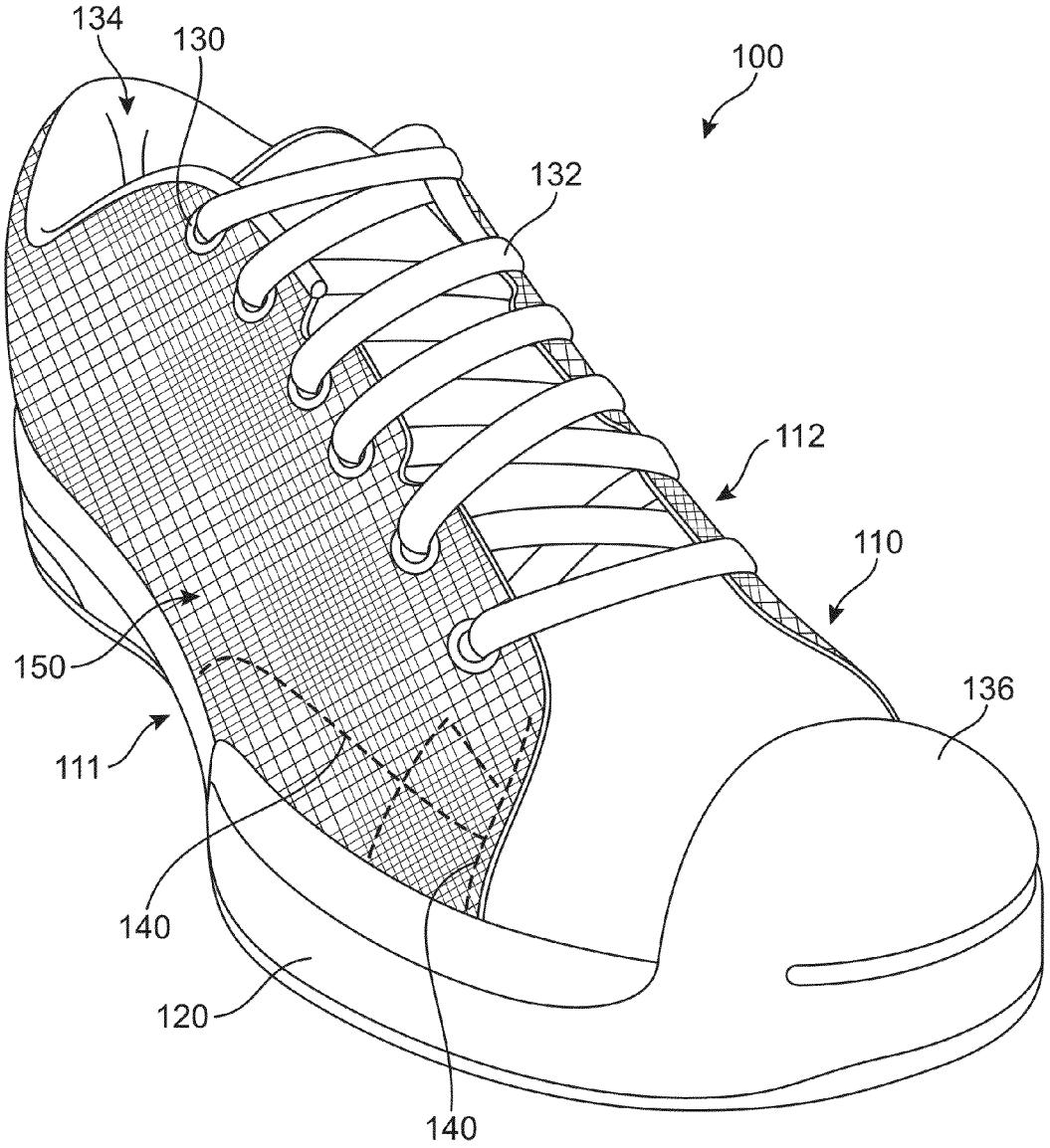
FIG. 2 is frontward view of an article of footwear, according to an embodiment.
Figure 3:
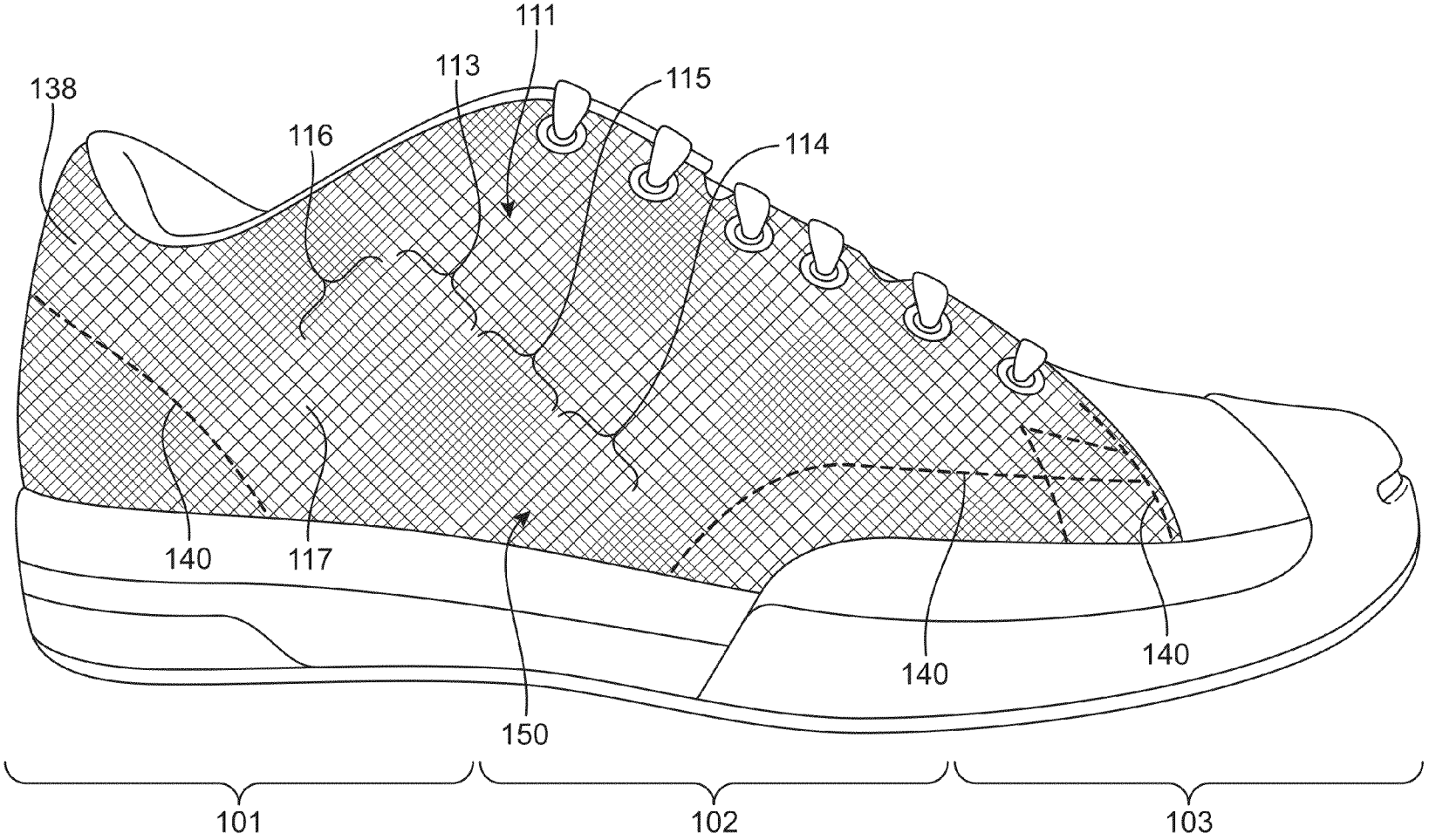
FIG. 3 is a view of the lateral side of the article of footwear of FIG. 2.
Figure 4:
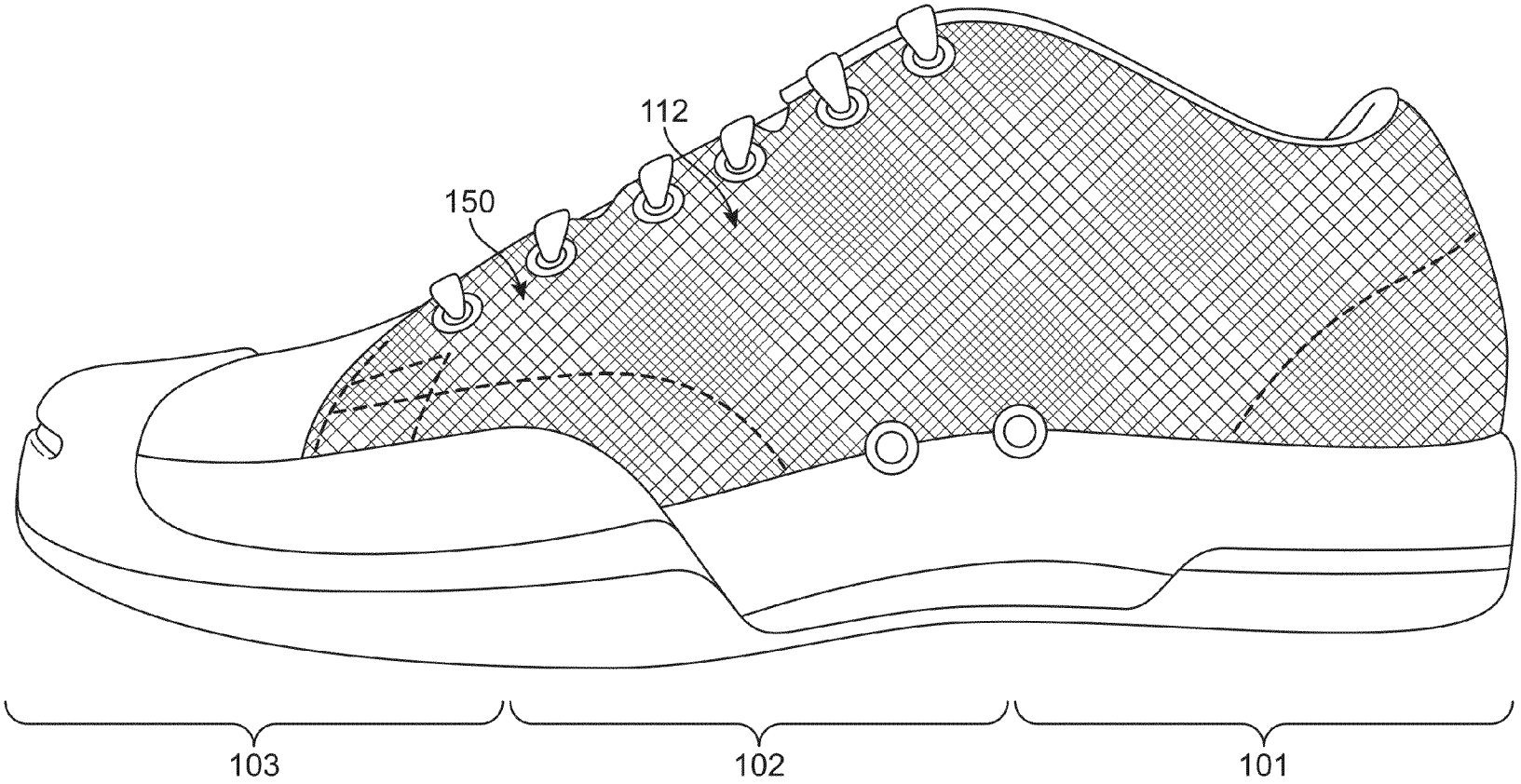
FIG. 4 is a view of the medial side of the article of footwear of FIG. 2.

Mesh materials described above may be included in an article of footwear to advantageously provide the article of footwear with enhanced strength and stretch resistance but also freedom to design various pleasing styles. For example, a mesh material itself can be used to incorporate various stylish designs into an article of footwear. Turning to the example of FIG. 2, an article of footwear 100 may include an upper 110 and a sole structure 120. FIG. 3 shows a view of the lateral side 111 of footwear 100 of FIG. 2 and FIG. 4 shows a view of medial side 112 of footwear 100. For reference purposes, footwear 100 may be divided into three general regions: a forefoot region 101, a midfoot region 102, and a heel region 103, as shown in FIGS. 3 and 4. Forefoot region 101 generally includes portions of footwear 100 corresponding with the toe portion 136 where toes and the joints connecting the metatarsals with the phalanges would be present. Midfoot region 102 generally includes portions of footwear 100 corresponding with the arch area of the foot, and heel region 103 corresponds with the heel portion 138 and rear portions of the foot, including the calcaneus bone. Regions 101-103, medial side 112, and lateral side 111 may be applied to sole structure 20, upper 30, and individual elements thereof. Regions 101-103, medial side 112, and lateral side 111 are not intended to demarcate precise areas of footwear 100. Rather, regions 101-103, medial side 112, and lateral side 111 are intended to represent general areas of footwear 100 to aid in the following discussion.

Sole structure 120 is secured to upper 110 and extends between the foot and a ground surface when footwear 100 is worn. Sole structure 120 may include a midsole, an outsole, and an sockliner (not shown). Midsole is secured to a lower surface of upper 110 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole may incorporate fluid-filled chambers, plates, moderators, or other elements that further attenuate forces, enhance stability, or influence the motions of the foot, or midsole may be primarily formed from a fluid-filled chamber. Outsole is secured to a lower surface of midsole and may be formed from a wear-resistant rubber material that is textured to impart traction. Sockliner is located within upper 110 and is positioned to extend under a lower surface of the foot. Although this configuration for sole structure 120 provides an example of a sole structure that may be used in connection with upper 110, a variety of other conventional or nonconventional configurations for sole structure 120 may also be utilized. Accordingly, the structure and features of sole structure 120 or any sole structure utilized with upper 110 may vary considerably.

Upper 110 defines a void 134 within footwear 100 for receiving and securing a foot relative to sole structure 120. The void 134 may be shaped to accommodate the foot and extend along the lateral side 111 of the foot, along the medial side 112 of the foot, over the foot, around the heel, and under the foot. A lace 132 extends through various lace apertures 130 and permits a wearer to modify dimensions of upper 110 to accommodate the proportions of the foot. More particularly, lace 132 permits the wearer to tighten upper 110 around the foot, and lace 132 permits the wearer to loosen upper 110 to facilitate entry and removal of the foot from the void 134. In addition, upper 110 may include a tongue (not depicted) that extends under lace 132.

According to an embodiment, upper 110 may include stitching 140. Stitching 140 can be used to join materials of upper 110 and/or to provide a stylish design to upper 110. For example, a thread can be used for stitching 140 that contrasts with surrounding material of upper 110 so that stitching 140 is more visible to provide a stylish design.

Various portions of upper 110 may be formed from one or more of a plurality of material elements (e.g., textiles, polymer sheets, foam layers, leather, synthetic leather) that are stitched or bonded together to form the void within footwear 100. Upper 110 may also incorporate a heel counter that limits heel movement in heel region 101 or a wear-resistant toe guard located in forefoot region 103. Although a variety of material elements or other elements may be incorporated into upper 110, areas of one or both of lateral side 111 and medial side 112 incorporate various strands 34.

The mesh material discussed above may be incorporated into footwear 100. According to an embodiment, mesh material 150 may be incorporated into the upper 110. As shown in the examples of FIGS. 2-4, the mesh material 150 may form, for example, a majority of the lateral side 111 and a majority of the medial side 112 of upper 110. As a result, mesh material 150 may have a configuration that (a) extends from higher areas of upper 110 to lower areas of upper 110 and through each of regions 101-103, (b) defines the various lace apertures 130, and (c) may form an exterior surface (i.e., an outer, exposed surface of footwear 100).

Mesh material 150 may include a first set 113 of high tensile strength strands, as shown in the example of FIG. 3. The high tensile strength strands enhance the strength and stretch resistance of the mesh material 150 and upper 110 that the mesh material 150 is incorporated into.

During walking, running, or other ambulatory activities, forces induced in footwear 100 may tend to stretch upper 110 in various directions, and the forces may be concentrated at various locations. That is, many of the material elements forming upper 110 may stretch when placed in tension by movements of the foot. Although high tensile strength strands may also stretch, high tensile strength strands generally stretch to a lesser degree than the other material elements forming upper 110. Mesh material 150 may be located, therefore, to provide structural components in upper 110 that strengthen the upper and resist stretching in specific directions or reinforce locations where forces are concentrated. Such a mesh material 150 may also provide weight savings by providing a lightweight structure that is relatively strong. High tensile strength strands may be positioned to provide stretch-resistance in particular directions and locations, and the number of high tensile strength strands may be selected to impart a desired degree of stretch-resistance. Accordingly, the orientations, locations, and quantity of high tensile strength strands may be selected to provide structural components that are tailored to a specific purpose.

As an example, the various high tensile strength strands that extend between lace apertures 130 and sole structure 120 resist stretch in the medial-lateral direction (i.e., in a direction extending around upper 110). These high tensile strength strands may also be positioned adjacent to and extend from lace apertures 130 to resist stretch due to tension in lace 132. Given that the high tensile strength strands cross other strands, whether the other strands be other high tensile strength strands or non-high tensile strength strands, forces from the tension in lace 132 or from movement of the foot may be distributed over various areas of upper 110. Accordingly, high tensile strength strands are located to form structural components in upper 110 that resist stretch.

According to an embodiment, mesh structure 150 may include high tensile strength strands which extend longitudinally along footwear 100 between forefoot region 103 and heel region 101. Such high tensile strength strands resist stretch in the longitudinal direction (i.e., in a direction extending through each of regions 101-103). In such an embodiment, high tensile strength strands may cross one another and permit forces from lace 132 at the various lace apertures 130 to be distributed more widely throughout upper 110.

According to an embodiment, mesh material 150 may be oriented so that the high tensile strength strands in mesh material 150 are angled relative to sole structure 120. For example, mesh material 150 may be oriented so that high tensile strength strands of mesh material 150, such as the high tensile strength strands of first set 113, are angled diagonally between sole structure 120 and lace aperture 130. The running style or preferences of an individual, for example, may determine the orientations, locations, and quantity of high tensile strength strands. For example, some individuals may have a relatively high degree of pronation (i.e., an inward roll of the foot), so providing a greater number of high tensile strength strands on lateral side 111 may reduce the degree of pronation. Some individuals may also prefer that upper 110 fit more snugly, which may require adding more high tensile strength strands throughout upper 110. Accordingly, footwear 100 may be customized to the running style or preferences of an individual through changes in the orientations, locations, and quantity of high tensile strength strands. In addition, the mesh material 150 may impart stretch-resistance to specific areas, reinforce areas, enhance wear-resistance, modify the flexibility, or provide areas of air permeability to upper 110. Accordingly, by controlling the orientations, locations, and quantity of strands, the properties of upper 110 and footwear 100 may be controlled.

Upper 110 may include a plurality of sets of high tensile strength strands, such as a second set 114 of high tensile strength strands, as shown in FIG. 3. Upper 110 may also include one or more sets of non-high tensile strength strands. For example, upper may include at least a third set of non-high tensile strength strands, as shown in FIG. 3. According to an embodiment, first set 113 of high tensile strength strands and second set 114 of high tensile strength strands may be arranged in an alternating pattern, with a third set 115 of non-high tensile strength strands located in between first set 113 of high tensile strength strands and second set 114 of high tensile strength strands, as shown in FIG. 3. Upper 110 may further include a fourth set 116 of non-high tensile strength strands which intersect first set 113 of high tensile strength strands and second set 114 of high tensile strength strands, as shown in FIG. 3. As a result, the non-high tensile strength strands of fourth set 116 may interlock with the high tensile strength strands of first set 114 and second set 162 to substantially hold the high tensile strength strands of first set 114 and second set 162 in place.

Based upon the above discussion, a mesh material 150 including high tensile strength strands may be utilized to form structural components in upper 110. In general, high tensile strength strands resist stretch to limit the overall stretch in upper 110. High tensile strength strands may also be utilized to distribute forces (e.g., forces from lace 132 and lace aperture 130) to different areas of upper 110. Accordingly, the orientations, locations, and quantity of high tensile strength strands may be selected to provide structural components that are tailored to a specific purpose. The high tensile strength strands of mesh material 150 may be arranged to impart one-dimensional stretch or multi-dimensional stretch. The mesh material may also include coatings that form a breathable and water resistant barrier, for example.

The strands forming mesh material 150 may be arranged so that mesh material 150 presents a stylish design. A design incorporating mesh material 150 that includes high tensile strength strands advantageously provides footwear 100 that has a high performance due to the enhanced strength and stretch resistance of mesh material 150, along with the weight savings afforded by mesh material 150 due to its high strength and stretch resistance without using a base layer or cover layer, but also a stylish design that is desirable for both athletic use and for casual use. For example, footwear 100 incorporating mesh material 150 may provide high performance when worn while playing tennis but also provides a design that is desirable not only during tennis play but during casual wear off the tennis court.

For example, the strands of mesh material 150 may be arranged in a plaid design, as shown in FIGS. 2-4. Such a plaid design can be produced, for example, by intersecting sets of high tensile strength strands and sets of non-high tensile strength strands in a mesh structure. In such a mesh structure the high tensile strength strands and non-high tensile strength strands may interlock with one another so that the high tensile strength strands are substantially held in place. The plaid design may include, for example, sets of high tensile strength strands that alternate with non-high tensile strength strands. As shown in FIG. 3, first set 113 of high tensile strength strands and second set 114 of high tensile strength strands may alternate with a third set 115 of non-high tensile strength strands.

According to an embodiment, high tensile strength strands may contrast with non-high tensile strength strands so that the high tensile strength strands stand out and are more visible than the non-high tensile strength strands. As shown in the example of FIG. 3, a high tensile strength strand 117 in first set 113 of high tensile strength strands may contrast and stand out from the surrounding non-high tensile strength strands that intersect or run adjacent to the high tensile strength strand 117. Such an effect may be accomplished, for example, by making the high tensile strength strand 117 thicker than the surrounding non-high tensile strength strands and/or by making the high tensile strength strand 117 a different color than the surrounding non-high tensile strength strands.

Figure 5:
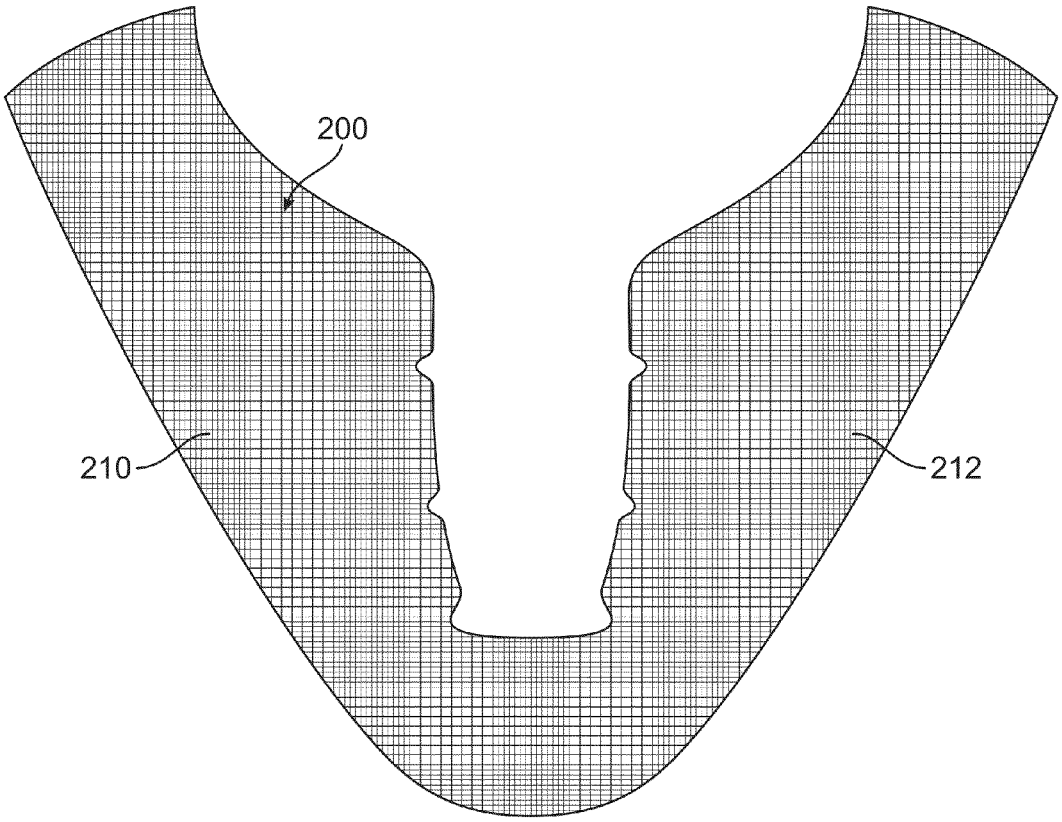
FIG. 5 is a top view of a mesh material, according to an embodiment.
Figure 6:
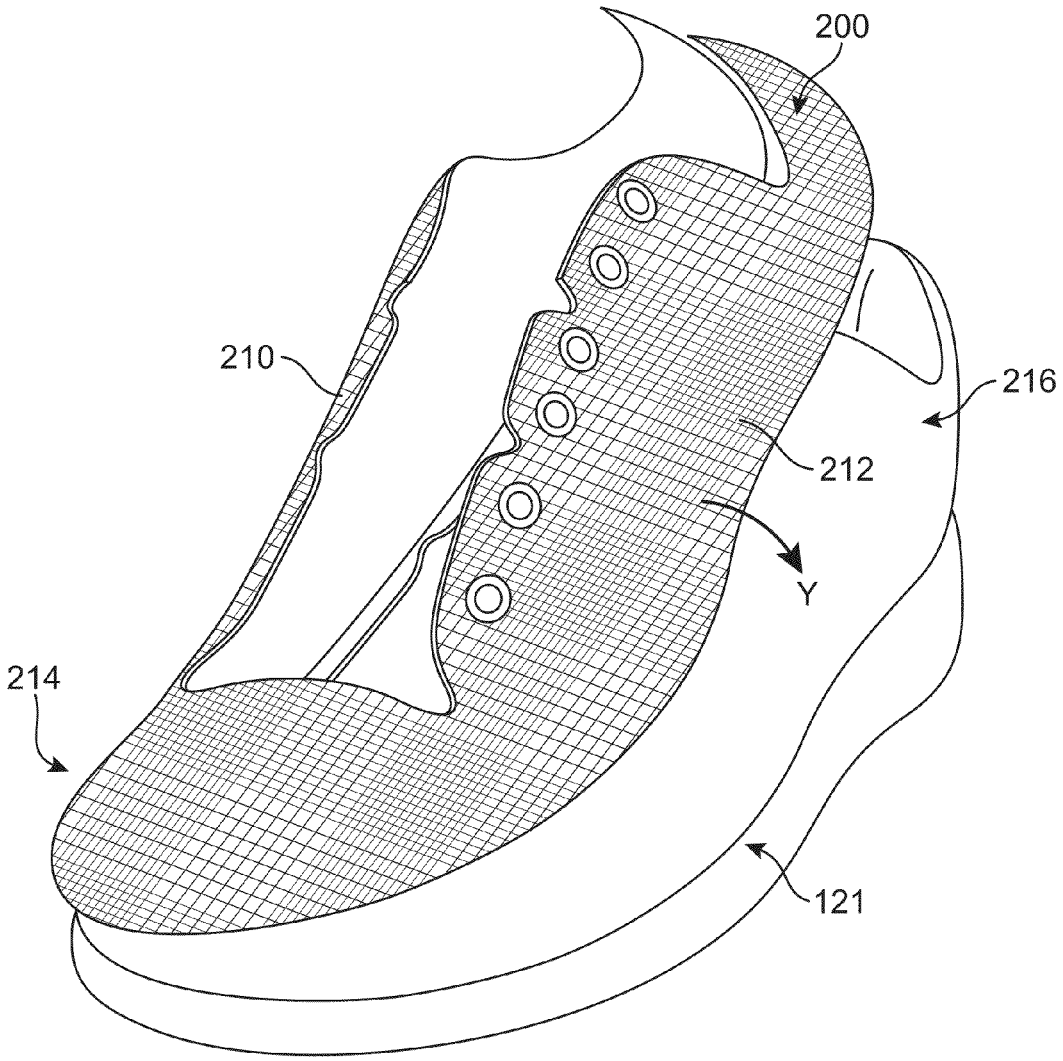
FIG. 6 illustrates a step of applying a mesh material during manufacture of an article of footwear, according to an embodiment.
Figure 7:
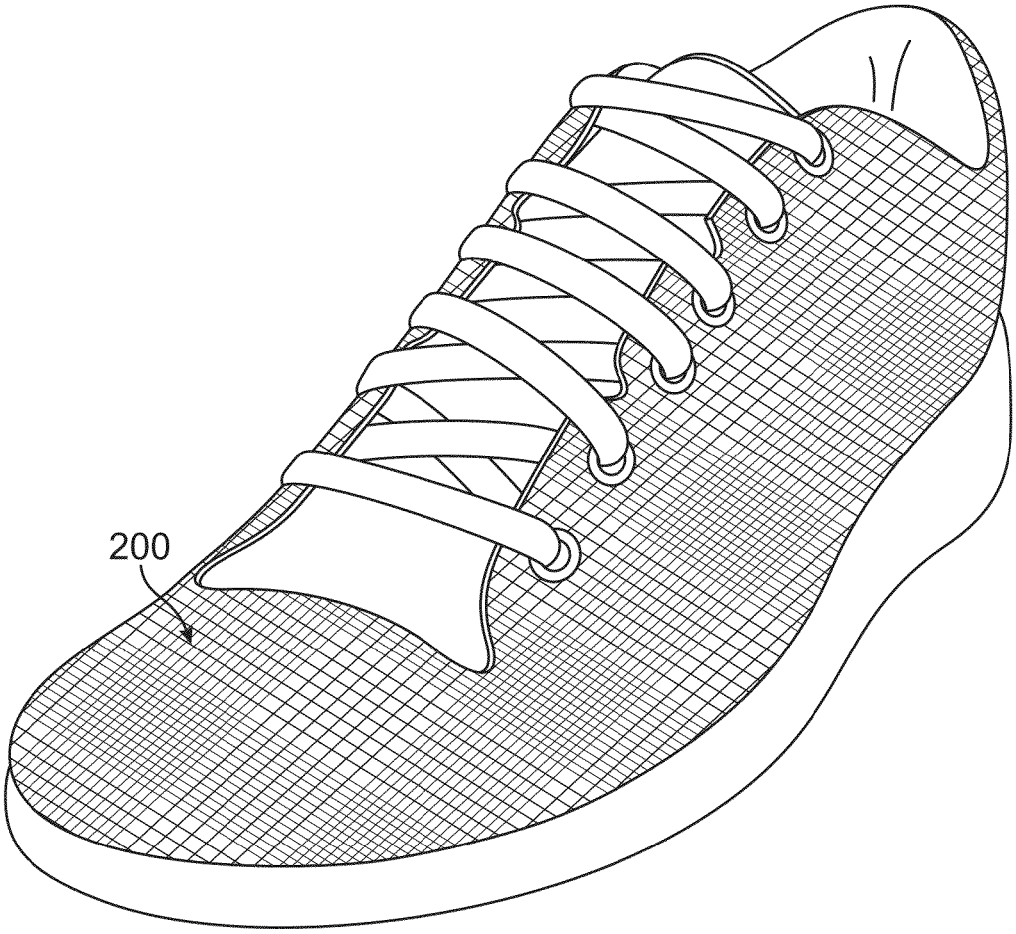
FIG. 7 shows a manufactured article of footwear after mesh material has been applied, according to an embodiment.

Mesh material may be incorporated into an article of footwear using various methods. According to an embodiment, mesh material can be provided in a sheet form which is then incorporated into an article of footwear. As shown in the example of FIG. 5, mesh material can be provided as a sheet 200 which has been cut into a desired shape corresponding to an article of footwear. For example, sheet 200 may be cut to correspond to a shape of an upper of an article of footwear. As shown in the example of FIG. 5, sheet 200 can be cut to include both a medial side 210 and a lateral side 212 that respectively correspond to the medial and lateral sides of an upper. Such a sheet 200 of mesh material can be applied to an upper 121 of an article of footwear by wrapping sheet 200 around upper 121, as shown in the example of FIG. 6. For example, sheet 200 of mesh material may be first applied to a toe portion 214 of upper 121 and then lowered along the direction indicated by arrow Y in FIG. 6 so that medial side 210 and lateral side 212 of sheet 200 are respectively wrapped around the sides of upper 121. The ends of medial side 210 and lateral side 212 of sheet 200 may then be wrapped around the heel portion 216 of upper 121 to provide an article of footwear including the sheet 200 of mesh material, as shown in the example of FIG. 7. Such an article of footwear incorporating the mesh material advantageously provides high performance due to the strength and stretch resistance of the mesh material but also provides a stylish design desirable for both athletic use and casual use.

Other methods can be used to incorporate mesh material into an article of footwear. According to an embodiment, discrete sections of mesh material that are separate from one another can be applied to the upper of an article of footwear to incorporate the mesh material into an article of footwear. The method of incorporating mesh material into an article of footwear may be selected according to a desired amount of mesh material to be incorporated into the article of footwear and according to a desired style or pattern for the article of footwear.

Mesh material that is incorporated into an article of footwear may have a structure that is breathable due to the woven or knitted structure of the mesh material. Such a woven or knitted structure is open to a degree and permits some air to pass through the mesh material. As a result, the mesh material, may advantageously make an upper that the mesh material is incorporated into more breathable. In addition, the structure of the mesh material can also be semi-transparent or translucent and permit a degree of light to pass through the mesh material. As a result, the mesh material may permit an observer to see materials or layers underneath the mesh material. Such an effect can be used, for example, to add styles or designs to an article of footwear by incorporating layers underneath the mesh material that can be viewed through the mesh material to a degree.

Figure 8:
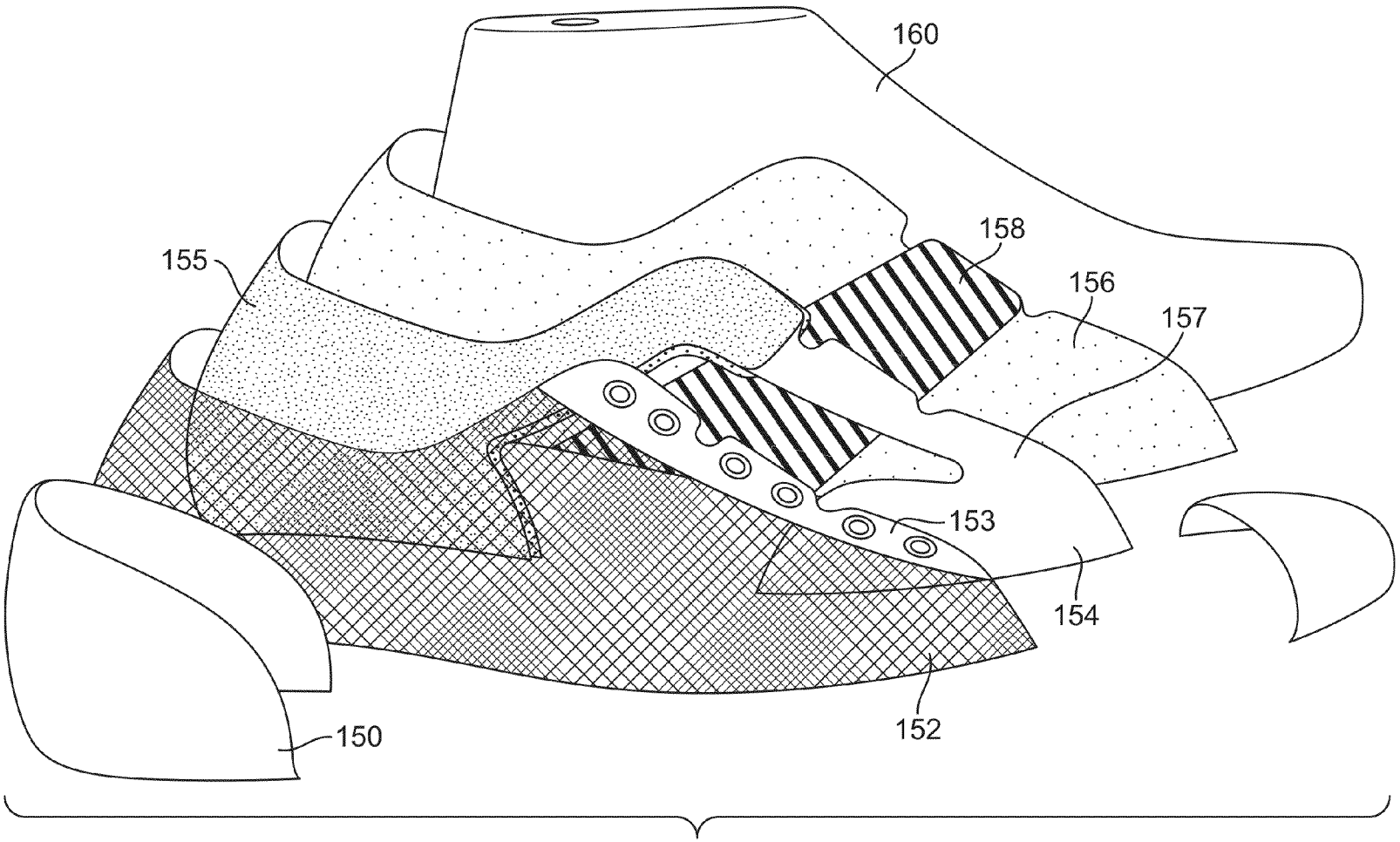
FIG. 8 is an exploded view of an article of footwear, according to an embodiment.
Figure 27:
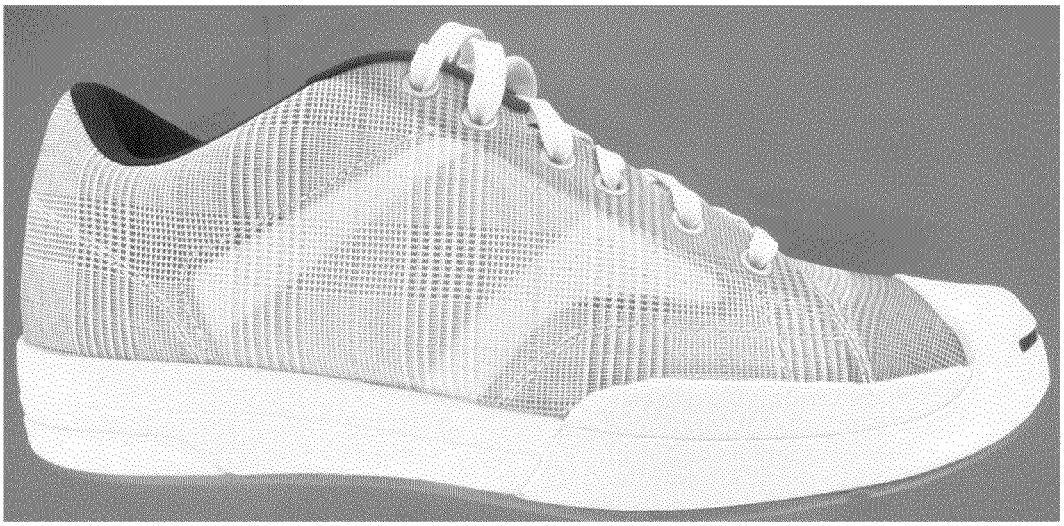
FIG. 27 is a picture of an article of footwear incorporating a mesh material having a plaid pattern, according to an embodiment.

Turning to FIG. 8, which shows an exploded view of an article of footwear that incorporates mesh material 152. Mesh material 152 can be semi-transparent or translucent, permitting an observer to see materials or layers underneath mesh material 152. For example, a layer 154 may be provided underneath mesh material 152. Layer 154 may include a rear portion 155 and a strip portion 157, as shown in the example of FIG. 8. The rear portion 155 and/or strip portion 157 of layer 154 may be provided to add to the stylish design of an article of footwear because layer 154 may be viewed through mesh material 152. For example, rear portion 155 may have a different color, design, or pattern than mesh material 152 and other surrounding materials so that the rear portion 155 of layer 154 is distinct may be more easily viewed through mesh material 152. Strip portion 157 may also be distinct from mesh material 152 and surrounding materials so that strip portion 157 may be more easily viewed through mesh material 152. According to such embodiments, layer 154 may contribute to the stylish design of an article of footwear by providing designs and/or colors viewable through mesh material 152. According to another embodiment, layer 154 is not necessarily distinct from mesh material 152, which may also contribute to the stylish design of an article of footwear. For example, a design for an article of footwear may be selected that minimizes distinctive designs and/or colors for a simplified, but stylish design. FIG. 27 is also included to provide a picture of an article of footwear incorporating a mesh material having a plaid pattern, according to an embodiment.

An article of footwear may also include a liner 156, which may act as a base layer. Similarly to layer 154, liner 156 may also be distinct from mesh material 152 and surrounding materials so liner 156 is more easily viewed through mesh material 152. As a result, liner 156 may contribute to the stylish design of an article of footwear by providing designs and/or colors viewable through mesh material 152. According to another embodiment, liner 156 is not necessarily distinct from mesh material 152, which may also contribute to the stylish design of an article of footwear.

Liner 156 may be formed from any generally two-dimensional material. As utilized with respect to the present invention, the term "two-dimensional material" or variants thereof is intended to encompass generally flat materials exhibiting a length and a width that are substantially greater than a thickness. Suitable materials for liner 156 include, for example, various textiles, polymer sheets, or combinations of textiles and polymer sheets. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. Polymer sheets may be extruded, rolled, or otherwise formed from a polymer material to exhibit a generally flat aspect. Two dimensional materials may also encompass laminated or otherwise layered materials that include two or more layers of textiles, polymer sheets, or combinations of textiles and polymer sheets. In addition to textiles and polymer sheets, other two-dimensional materials may be utilized for liner 156. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness.

As shown in the example of FIG. 8, an article of footwear may also include a strap 158 and a heel counter 150. Strap 158 may help to secure the upper of an article of footwear to a foot 160 and thus improve the feel of the article of footwear. A strap 158 can be provided, for example, on either or both of the medial and lateral sides of an article of footwear. Strap 158 can be located underneath mesh material 152 or be located underneath mesh material 152. According to an embodiment, strap 158 may be distinctive from mesh material 152 so that strap 158 is more easily viewed through or relative to mesh material 152. As a result, strap 158 may contribute to an overall stylish design of an article of footwear due to its distinctive color and/or pattern. According to another embodiment, strap 158 is not necessarily distinct from mesh material 152, which may also contribute to the stylish design of an article of footwear.

Mesh material 152 may be joined to the upper of an article of footwear to secure mesh material 152 in place. According to an embodiment, mesh material 152 may be joined to a strip portion 153. For example, a top portion of mesh material 152 may be welded to strip portion 153 and a bottom portion of mesh material may be joined to the sole structure of the article of footwear. Strip portion 153 may be made of a material suitable to provide a desired design or color. For example, the strip portion 153 may be made of thermoplastic polyurethane (TPU).

According to an embodiment, mesh material 152 itself may be colored. Providing color to mesh material 152 may add to the stylish design of mesh material 152 and the article of footwear it is incorporated into. For example, the strands of mesh material 152 may be colored. Such stands may be colored the same color or different strands may be colored different colors. In the example of a plaid design for mesh material 152, the strands of mesh material 152 may have different colors to accentuate the plaid pattern. According to an embodiment, the strands of mesh material 152 may include high tensile strength strands made of, for example, nylon, and non-high tensile strength strands made of, for example, polyester. The mesh material 152 may then be dyed so that the non-high tensile strength strands become colored while the high tensile strength strands are not colored. In such an example, the non-colored high tensile strength strands would be distinct and stand out against the colored non-high tensile strength strands. For example, mesh material 152 may be dip dyed to color non-high tensile strength strands made of polyester.

Figure 9:
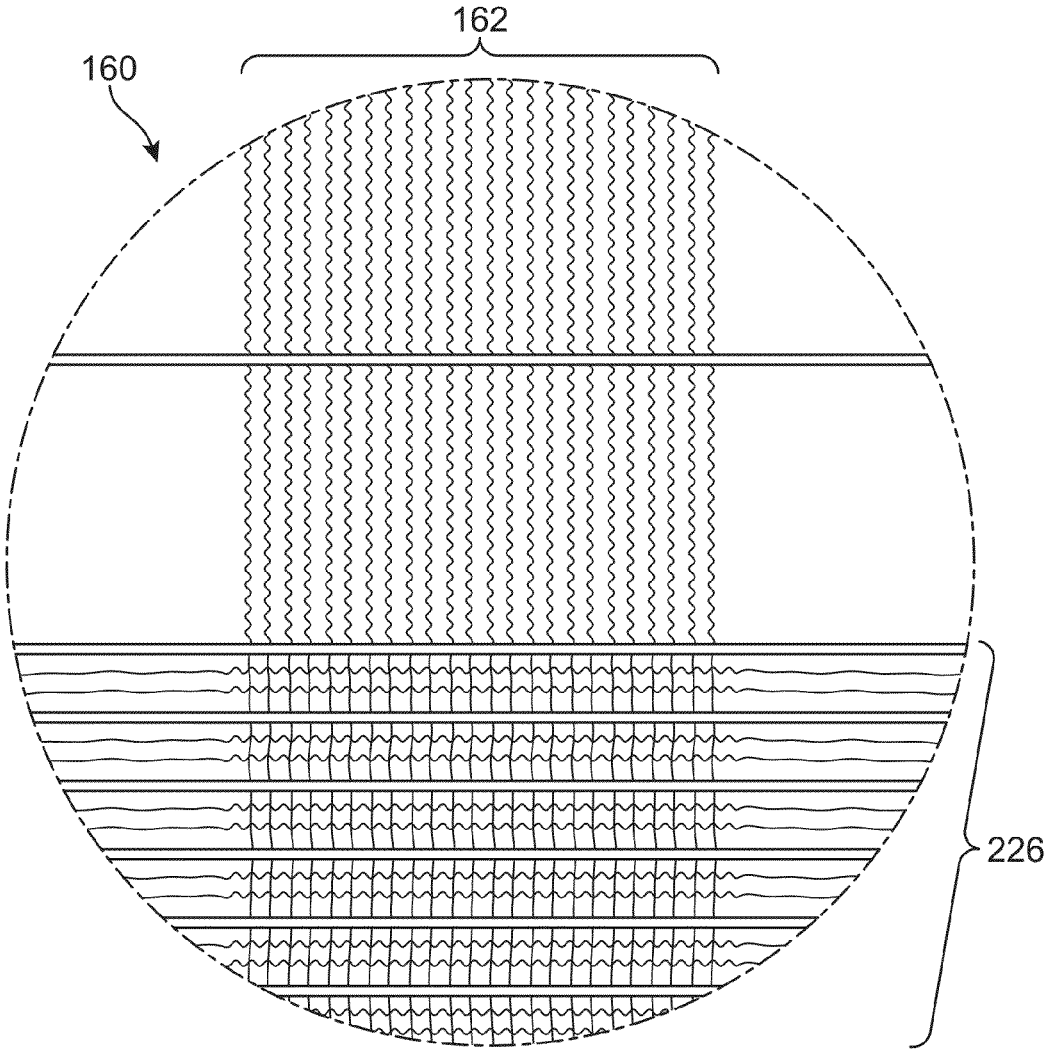
FIG. 9 is a top view of a mesh material, according to an embodiment.

As discussed above, the mesh material incorporated into an upper of an article of footwear may be a woven material. Turning to FIG. 9, a mesh material 160 may include a first set 226 of high tensile strength strands that intersect and are woven with a second set 162 of non-high tensile strength strands to provide strength and stretch resistance to mesh material 160, while substantially holding first set 226 high tensile strength strands in place. Mesh material 160 may include additional sets of high tensile strength strands and additional sets of non-high tensile strength strands. The sets of high tensile strength strands and non-high tensile strength strands may be arranged in alternating patterns to provide a design.

Figure 10:
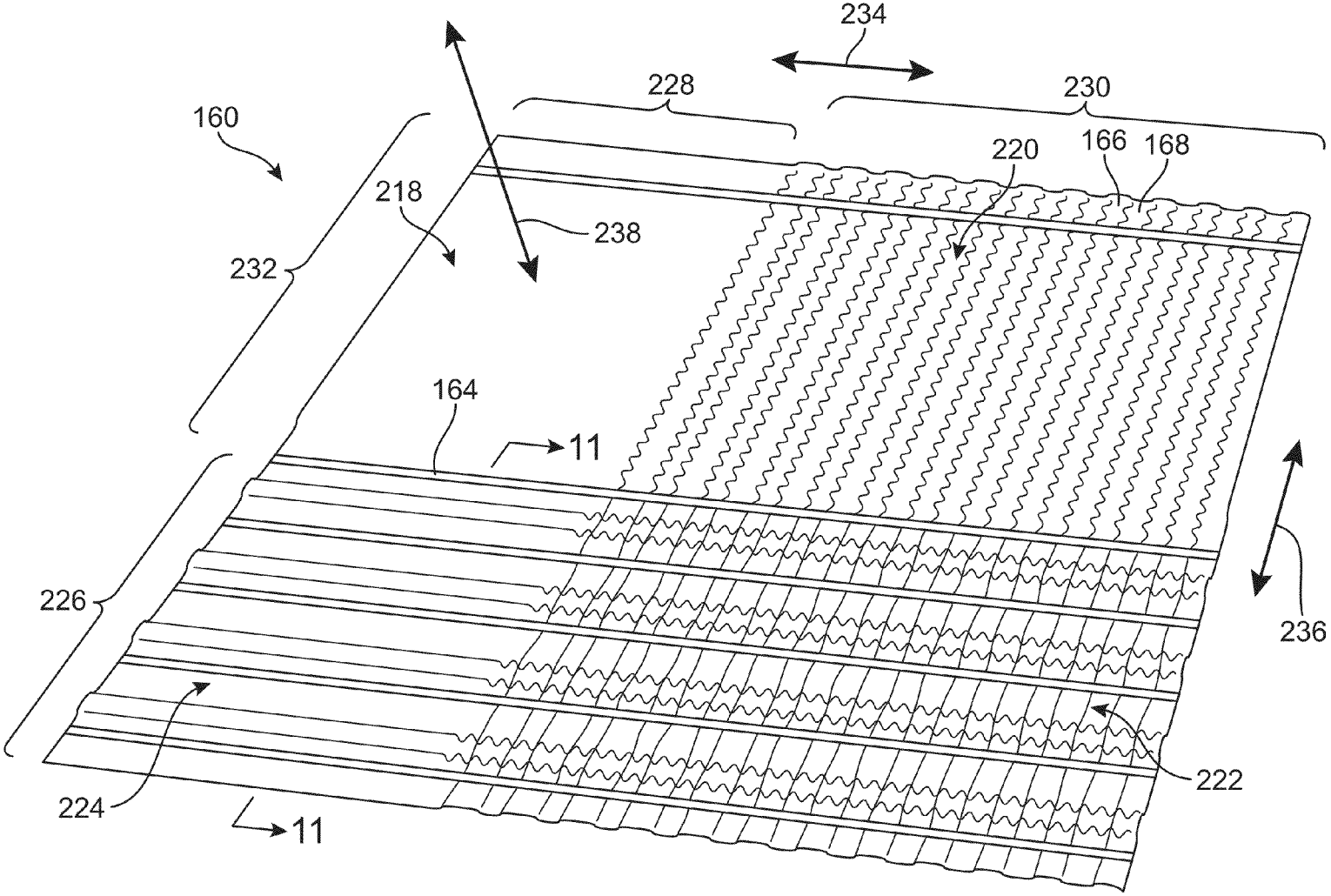
FIG. 10 is an isometric view of the mesh material of FIG. 9.

As shown in the example of FIG. 10, which is an isometric view of the mesh material 160 of FIG. 9, sets of strands of mesh material 160 may be woven into a stylish pattern, such as, for example, a plaid design. According to an embodiment, first set 226 of high tensile strength strands may be woven with an second set 228 of non-high tensile strength strands and a third set 230 of non-high tensile strength strands. For example, first set 226 of high tensile strength strands may extend in a warp direction 234 of mesh material 160, while second set 228 of non-high tensile strength strands and third set 230 of non-high tensile strength strands extend in a weft direction 236. Such a woven pattern would provide, for example, a mesh material 160 that substantially resists stretch in warp direction 234 and weft direction 236 but may permit some stretch in a direction 238 (a bias direction) that is diagonal to warp direction 234 and weft direction 236. The diagonal direction 238 may extend, for example, at substantially a 45 degree angle between the warp direction 234 and weft direction 236.

As a result, mesh material 160 may have, for example, enhanced strength and stretch resistance in warp direction 234 and weft direction 236 (e.g., along the directions first set 226 of strands and second set 228 of strands extend) but may permit some stretch in diagonal direction 23.

According to an embodiment, second set 228 of non-high tensile strength strands and third set 230 of non-high tensile strength strands may intersect with the high tensile strength strands of first set 226 to provide an interlocking pattern between the high tensile strength strands and non-high tensile strength strands. Such an interlocking pattern may substantially hold the high tensile strength strands in place while providing strength and stretch resistance to the plaid design.

Figure 11:
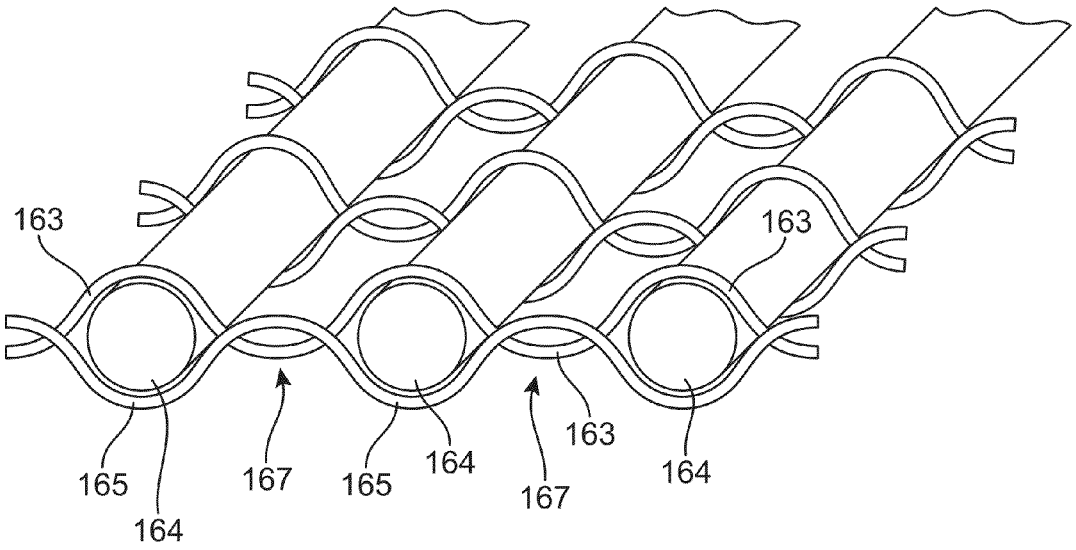
FIG. 11 is a cross-sectional view of the mesh material of FIG. 10.

For example, as shown in FIG. 11, which is a cross-sectional view along line 11-11 in FIG. 10, individual high tensile strength strands 164 may intersect and interlock with non-high tensile strength strand 163 and non-high tensile strength strand 165 which extend in weft direction 236. As shown in the example of FIG. 11, non-high tensile strength strand 163 may pass over each high tensile strength strand 164 while non-high tensile strength strand 165 passes under each high tensile strength strand 164. In a region 167 between high tensile strength strands 164, non-high tensile strength strand 163 and non-high tensile strength strand 165 may pass one another and may be woven or connected to one another. For example, another non-high tensile strength strand (not shown) may pass between non-high tensile strength strand 163 and non-high tensile strength strand 165 in region 167, such as through a loop formed by non-high tensile strength strand 163 and non-high tensile strength strand 165, to weave non-high tensile strength strand 163 and non-high tensile strength strand 165 in region 167.

According to an embodiment, mesh material 160 may further include a fourth set 232 of non-high tensile strength strands which extend along the warp direction 234. Fourth set 232 of non-high tensile strength strands may intersect and weave with the non-high tensile strength strands of second set 228 and third set 230. According to an embodiment, the weaving pattern formed between the strands of first set 226 and second set 228 and third set 230, and between fourth set 232 and second set 228 and third set 230, may be selected to provide different regions of mesh material 160 with different patterns. For example, a first region 218, a second region 220, a third region 222, and a fourth region 224 of mesh material 160 may have different patterns to provide a plaid design. A plaid design provided by the weaving patterns of first region 218, second region 220, third region 222, and fourth region 224 may be alternately repeated, for example, in the warp direction 234 and weft direction 236 to provide a mesh material 160 with a plaid design.

Figure 12A:
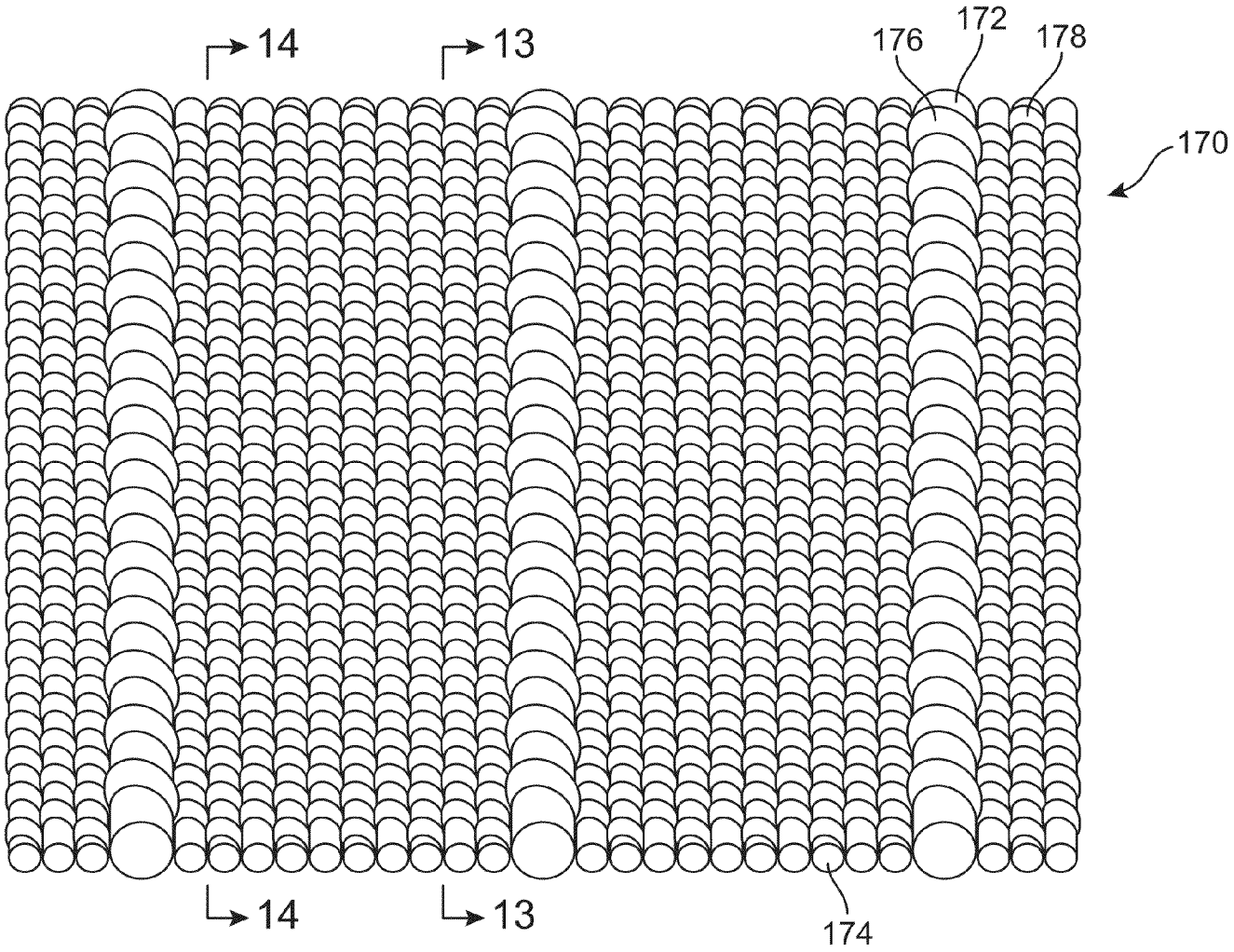
FIG. 12A is a view of a mesh material, according to an embodiment.
Figure 12B:
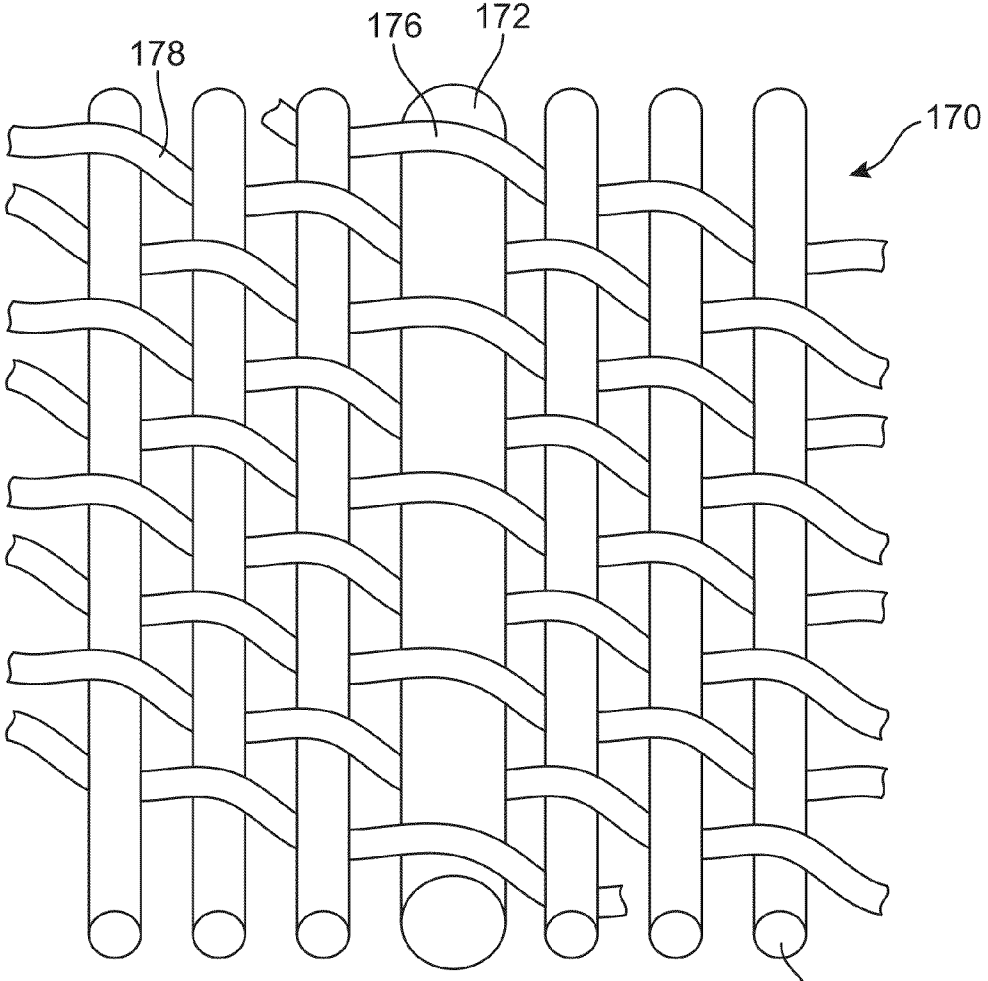
FIG. 12B is an enlarged view of the mesh material of FIG. 12A.

FIG. 12A shows an example of a weaving pattern for a mesh material 170, according to an embodiment. Mesh material 170 may include a high tensile strength stand 172 which intersects and interlocks with a non-high tensile strength stand 176 and a non-high tensile strength stand 178. FIG. 12B shows an enlarged view of the mesh material 170 of FIG. 12A to assist with viewing the weaving pattern of mesh material 170. For example, non-high tensile strength stand 176 and non-high tensile strength stand 178 may alternately weave over and under high tensile strength strand 172 to provide a weaving pattern which substantially holds high tensile strength strand 172 in place.

Figure 13:
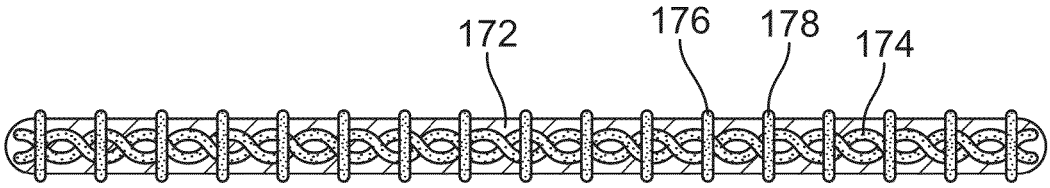
FIG. 13 is a cross-sectional view along line 13-13 in FIG. 12A.
Figure 14:
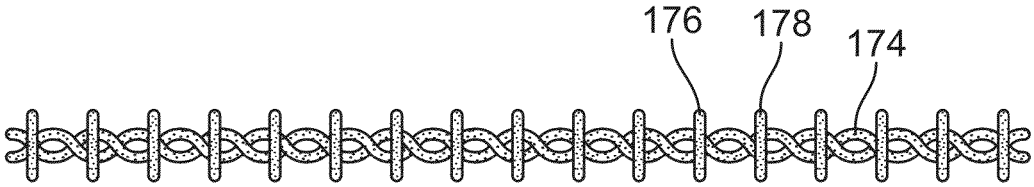
FIG. 14 is a cross-sectional view along line 14-14 in FIG. 12A.
Figure 15:
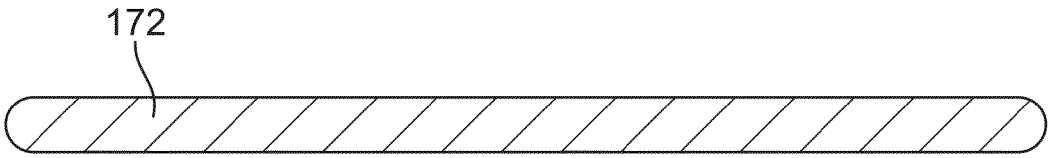
FIG. 15 is a side view of a high tensile strength strand, according to an embodiment.

In addition, mesh material 170 may include a non-high tensile strength strand 174 which extends in substantially the same direction as high tensile strength strand 172 and interlocks with non-high tensile strength stand 176 and non-high tensile strength stand 178, as shown in FIGS. 13 and 14. Such a weaving pattern formed between high tensile strength strand 172, non-high tensile strength stand 176, non-high tensile strength stand 178, and non-high tensile strength stand 174 may be repeated through mesh material to provide a desired pattern. FIG. 15 shows a side view of an exemplary high tensile strength strand 172.

As discussed above, a mesh material may be oriented so that high tensile strength strands of mesh material are angled diagonally between a sole structure and a lace aperture for a lace. According to another embodiment, the high tensile strength strands of a mesh material may be oriented in a substantially vertical direction between a sole structure and lace aperture.

Figure 16:
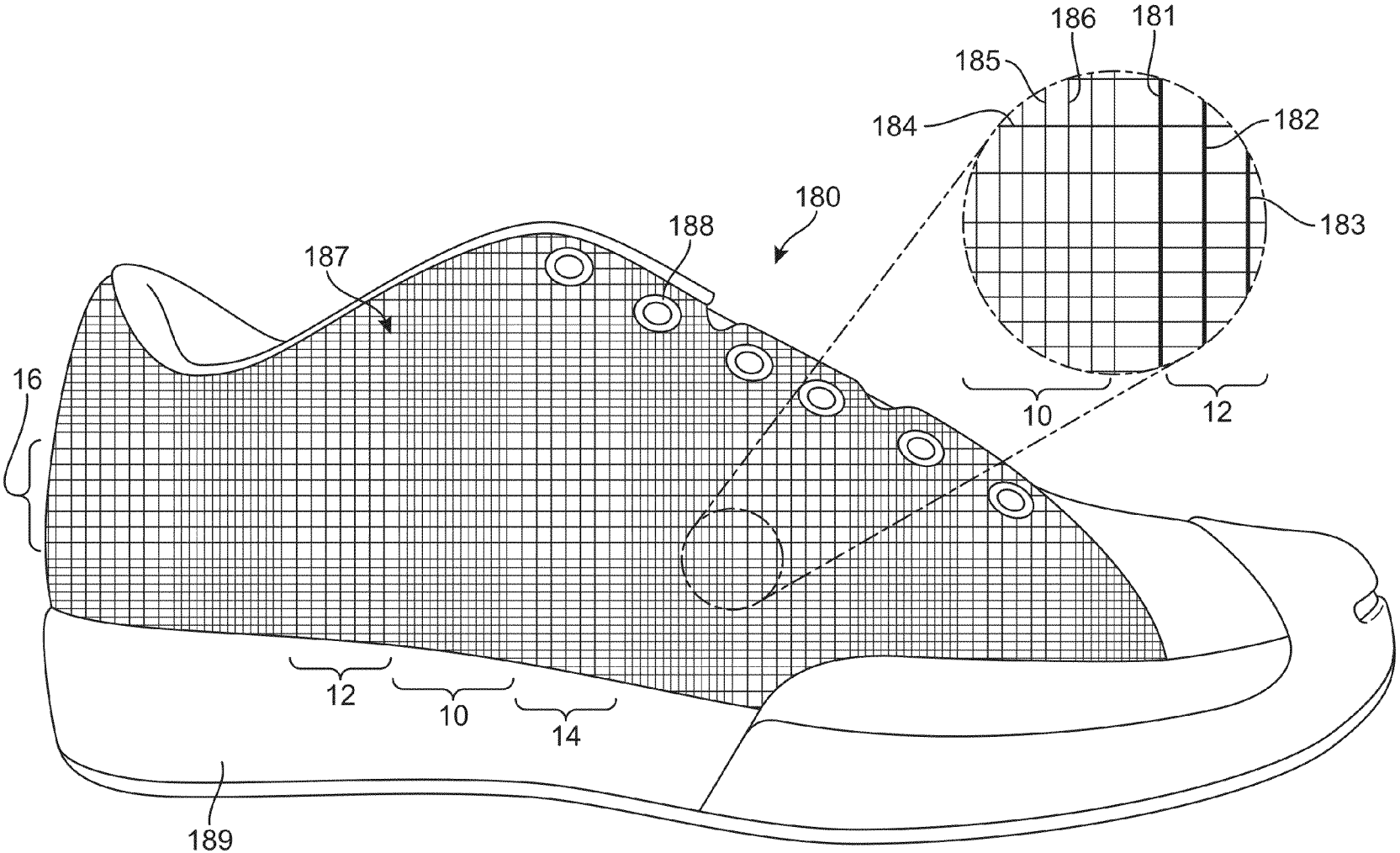
FIG. 16 is a side view of an article of footwear, according to an embodiment.

Turning to FIG. 16, an article of footwear 180 may include a mesh material 187. Mesh material 187 may in turn include a first set 12 of high tensile strength strands and a second set 10 of non-high tensile strength strands. As shown in the enlarged portion of FIG. 16, first set 12 may include a first high tensile strength strand 181, a second 182 high tensile strength strand, and a third high tensile strength strand 183, although any number of high tensile strength strands may be included in first set 12. For example, the number of high tensile strength strands in first set 12 may be varied according to a desired strength or stretch resistance for mesh material 187.

Further, as shown in the enlarged portion of FIG. 16, second set 10 may include a first non-high tensile strength strand 184, a second non-high tensile strength strand 185, and a second non-high tensile strength strand 186, although second set 10 may include any number of non-high tensile strength strands. Mesh material 187 may include other sets of strands, such a third set 14 of high tensile strength strands and a fourth set 16 of strands, with the fourth set 16 being a set of high tensile strength strands or non-high tensile strength strands that intersect the strands of first set 12, second set 10, and third set 14. According to an embodiment, the alternating pattern of first set 12 of high tensile strength strands, second set 10 of non-high tensile strength strands, and third set 14 of high tensile strength strands may be repeated in horizontal and vertical directions to provide mesh material 187 with a desired pattern, such as, for example, a plaid pattern.

As shown in the example of FIG. 16, the high tensile strength strands of first set 12 and the non-high tensile strength strands of second set 10 may extend in a substantially vertical direction between a sole structure 189 and a lace aperture 188 of footwear 180.

Sets of high tensile strength strands and sets of non-high tensile strength strands can include various numbers of strands and the respective sets may have various widths. The number of strands and width for a given set of strands may be selected, for example, according to a desired strength and stretch resistance for a mesh material 187. For example, a first set 12 of high tensile strength strands may have a width in a horizontal direction (which is substantially perpendicular to the vertical direction extending between sole structure 189 and lace aperture 188) of approximately 0.5 cm to 4.0 cm. Second set 10 of non-high tensile strength strands may have a width corresponding to first set 12 or may have a different width falling within the range of approximately 0.5 cm to 4.0 cm. Third set 14 of high tensile strength strands may have the same width as first set 12 or may have a different width to provide mesh material 187 with a design that varies. Fourth set 16 of strands may have a height in the vertical direction that is the same as the width of first set 12, such as when a pattern of repeating squares is desired for mesh material 187, or may have a height that differs and falls within the range of approximately 0.5 cm to 4.0 cm.

Figure 17:
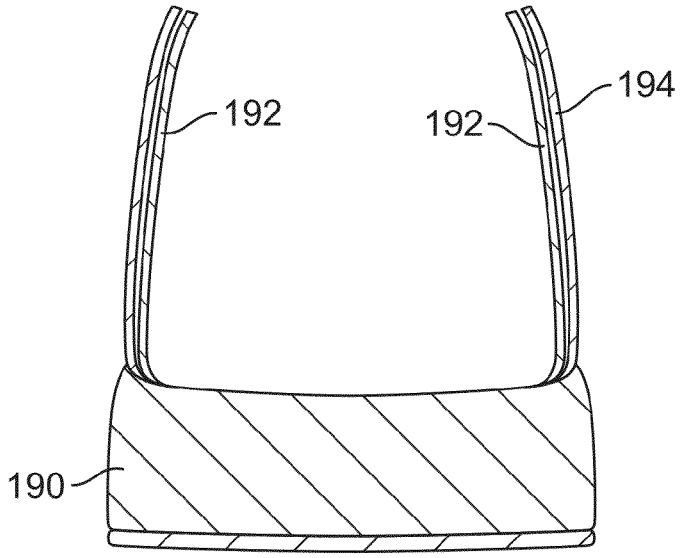
FIG. 17 is a cross-sectional view of an article of footwear, according to an embodiment.

As discussed above, due to the structure of the mesh material, the mesh may be at least semi-transparent. As a result, the mesh material may be layered over other materials to provide additional patterns or designs to an article of footwear. As shown in the example of FIG. 17, which shows a cross-section of an article of footwear, a mesh material 194 may be layered over another layer 192, such as a liner, and connected to a sole structure 190. As discussed above, layer 192 may have a color, design, or pattern which enhances the design provided by mesh material 194.

Figure 18:
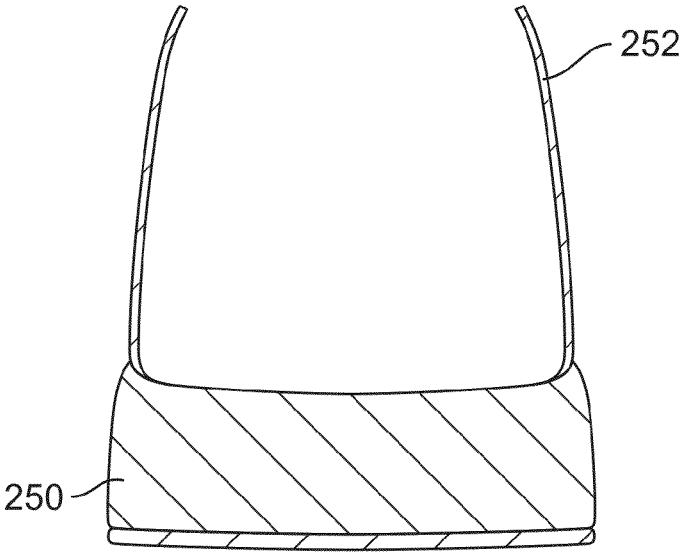
FIG. 18 is a cross-sectional view of an article of footwear, according to an embodiment.

Because the mesh material itself may provide strength, stretch resistance, and a stylish design, as well as being breathable, an article of footwear may be provided in which the mesh material provides the main layer for the upper, according to an embodiment. As shown in the example of FIG. 18, a mesh material 252 may be connected to a sole structure 250 and act as a main layer for an upper. Such a mesh material 252 may, for example, be the only layer provided for an upper in portions of the upper and may provide substantially the entire thickness of the upper in those portions where only the mesh material 252 is present, as shown in FIG. 18. Such an embodiment advantageously provides an article of footwear that requires less material for an upper and its liner, providing a structure that is lightweight, provides weight savings, and permits more air to flow freely around a foot within the article of footwear.

Mesh material may be formed into patterns employing principles other than those described above, such as patterns other than the plaid pattern described above. According to an embodiment, mesh material may be formed into a herringbone pattern. Such a herringbone pattern may be formed, for example, by a knitted mesh material.

Figure 19:
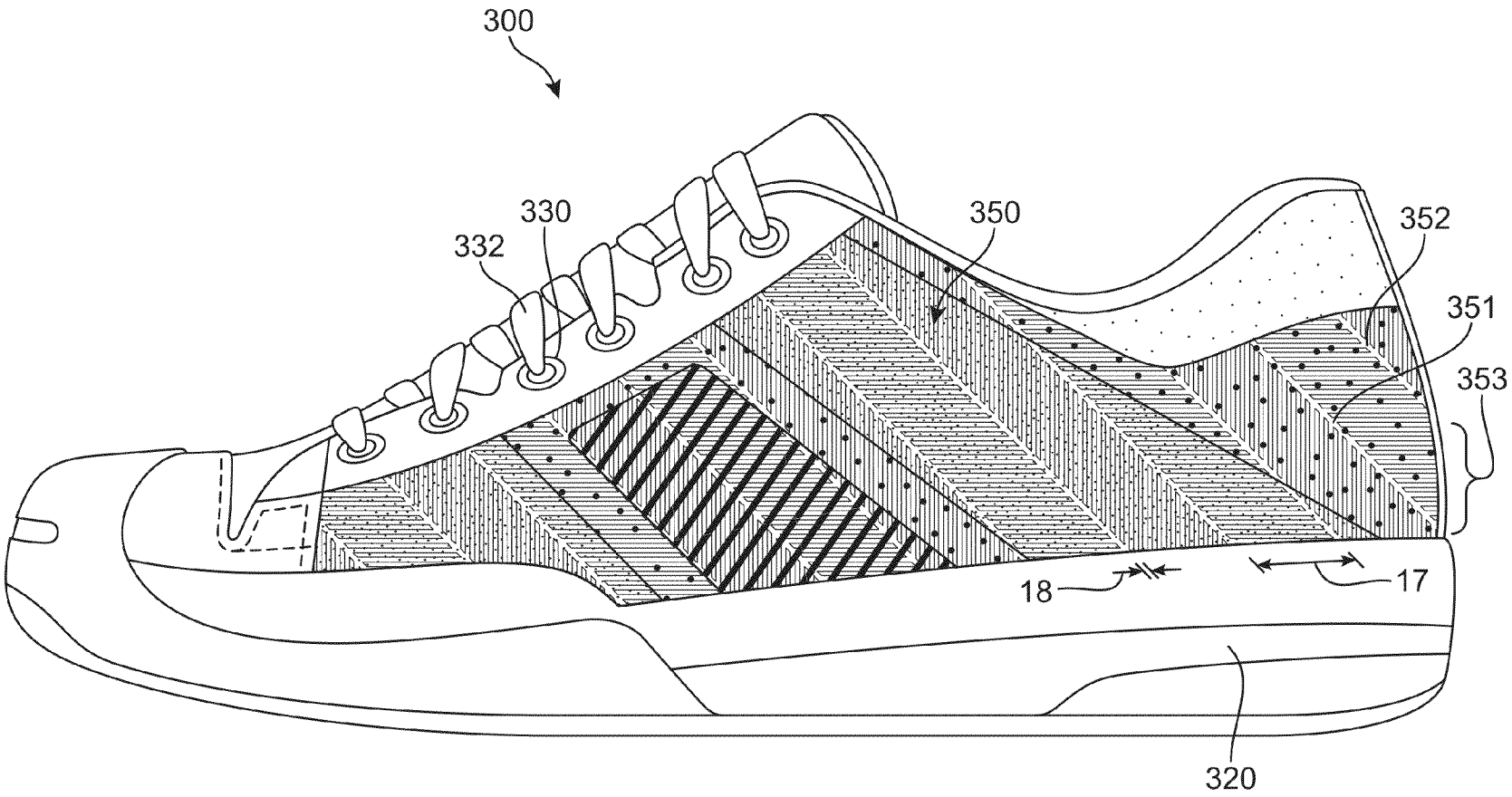
FIG. 19 is a side view of an article of footwear, according to an embodiment.
Figure 28:
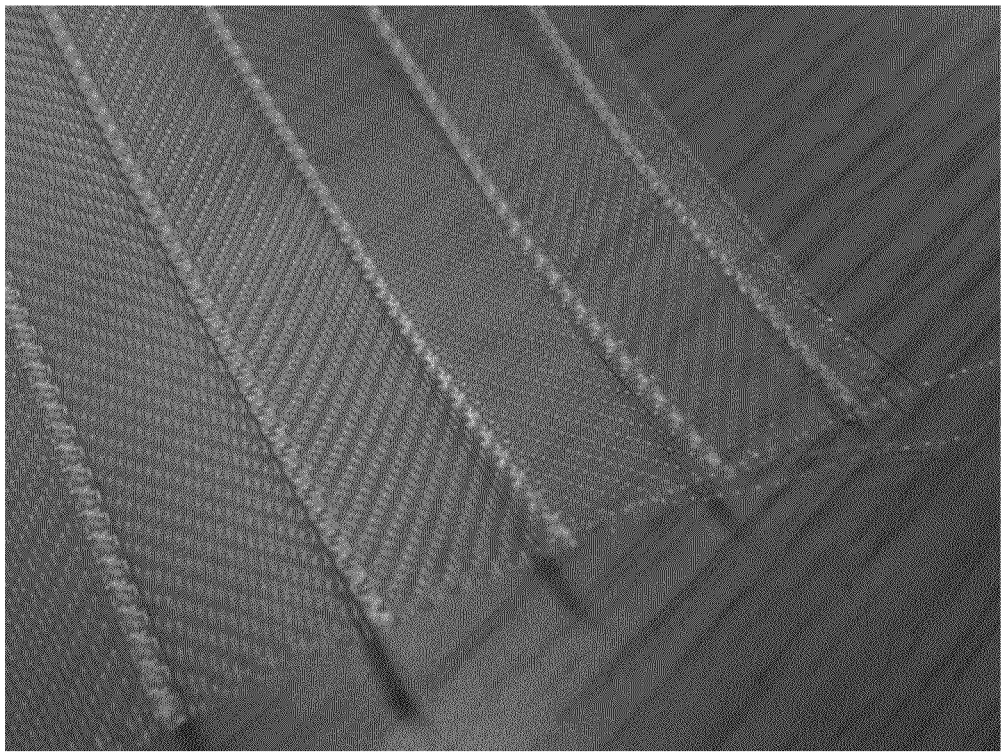
FIG. 28 is a picture of a mesh material having a herringbone pattern, according to an embodiment.

FIG. 19 shows a side view of an article of footwear 300 which incorporates mesh material 350 formed in a herringbone pattern. Mesh material 350 may include a plurality of high tensile strength strands, such as a first high tensile strength strand 351 and a second high tensile strength strand 352. A set of non-high tensile strength strands 353 may be located between high tensile strength strand 351 and second high tensile strength strand 352. According to an embodiment, set of non-high tensile strength strands 353 may intersect with high tensile strength strand 351 and second high tensile strength strand 352 to form an interlocking mesh structure that substantially holds high tensile strength strand 351 and high tensile strength strand 352 in place. For example, set of non-high tensile strength strands 353 may form a knitted structure in which high tensile strength strand 351 and high tensile strength strand 352 are knitted together by loops formed by the non-high tensile strength strands of set 353. FIG. 28 is included to provide a picture of a mesh material having a herringbone pattern, according to an embodiment.

According to an embodiment, each of high tensile strength strand 351 and high tensile strength strand 352 may have a width 18 of approximately 0.5 cm to 4.0 cm. According to an embodiment, set 353 of non-high tensile strength strands may have a width 17 of approximately 0.5 cm to 4.0 cm.

As shown in the example of FIG. 19, high tensile strength strand 351, high tensile strength strand 352, and set 353 of non-high tensile strength strands may be oriented at an angle between sole structure 320 and lace aperture 330 for lace 332. According to another embodiment, the high tensile strength strands and non-high tensile strength strands may be oriented to extend in a substantially vertical direction between sole structure 320 and lace aperture 330.

Figure 20A:
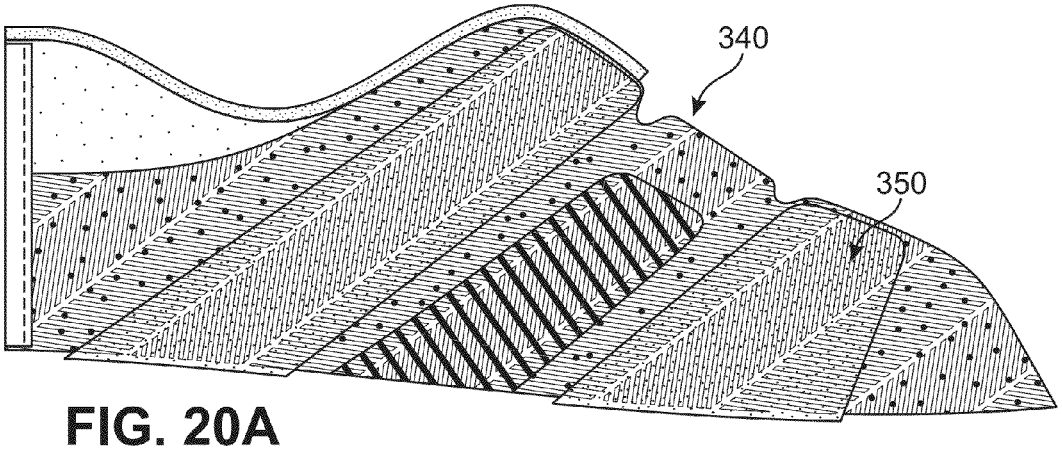
FIG. 20A is a side view of an upper of an article of footwear, according to an embodiment.
Figure 20B:
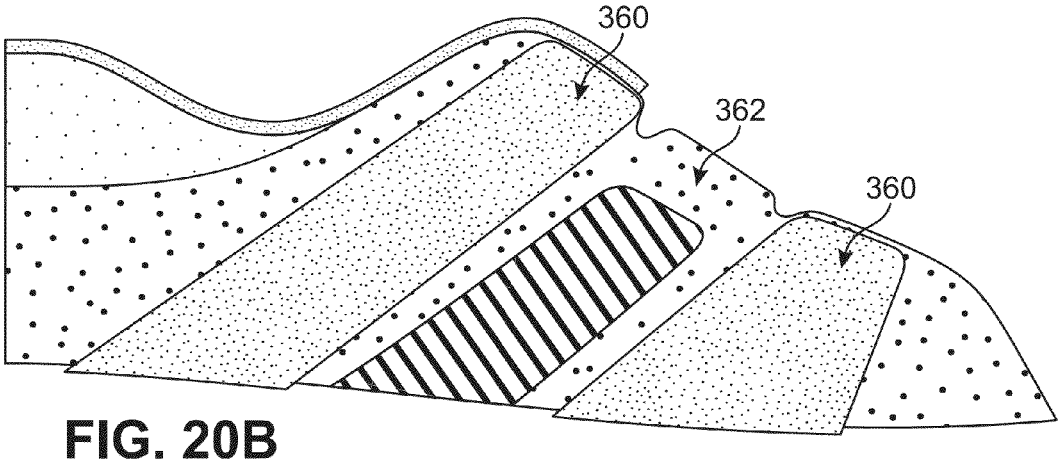
FIG. 20B is a side view of the upper of FIG. 20A with mesh material removed.
Figure 20C:
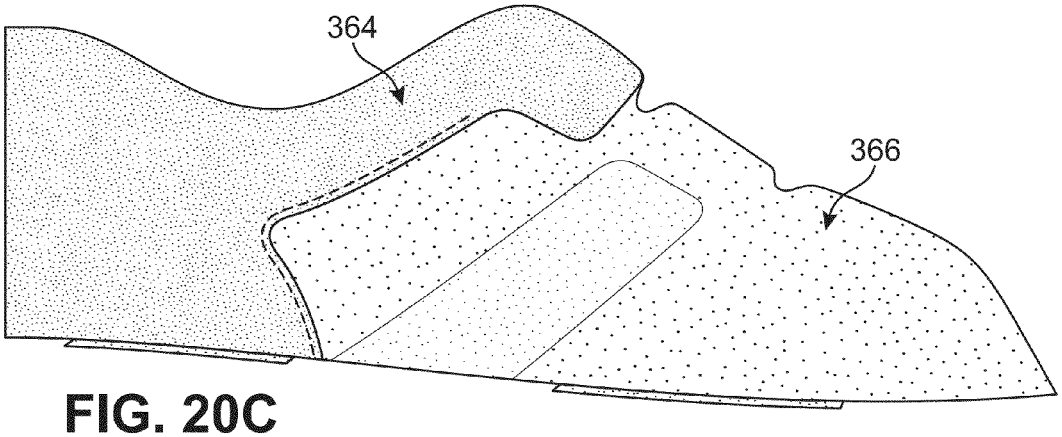
FIG. 20C is a side view of the upper of FIG. 20B with intermediate layers removed.

Mesh material used for a herringbone pattern may have the characteristics of mesh materials described above. For example, the mesh material used for a herringbone pattern may be semi-transparent and permit layers and materials underneath the mesh material to be viewed by an observer. Turning to FIG. 20A, a completed upper 340 of an article of footwear is shown which incorporates mesh material 350 in a herringbone pattern. FIG. 20B shows the upper 340 of FIG. 20A with mesh material 350 removed to more clearly show the layers underneath mesh material 350. According to an embodiment, upper 340 may include one or more straps 360 underneath mesh material 350. Strap 360 may be provided to assist in securing upper 340 to a foot and improve the feel of an article of footwear. An intermediate layer 362 may also be provided underneath mesh material 350. Strap 360 and/or intermediate layer 362 may have a color and/or pattern which contributes to the design of mesh material 350. For example, strap 360 and/or intermediate layer 362 may have a color and/or design which is distinctive from mesh material 350. In another example, strap 360 and/or intermediate layer 362 may have a color and/or design which is not distinctive from mesh material 350. According to an embodiment, upper 340 may further include a liner 366 provided underneath mesh material 350 and intermediate layer 362, when intermediate layer 362 is present. Liner 366 may have a color and/or pattern which contributes to the design of mesh material 350. In addition, liner 366 may have different portions with different colors and/or patterns. For example, liner 366 may include a portion 364 having a different color and/or pattern than the remainder of liner 366 when a different design or color is desired for different portions of liner 366.

Figure 21:
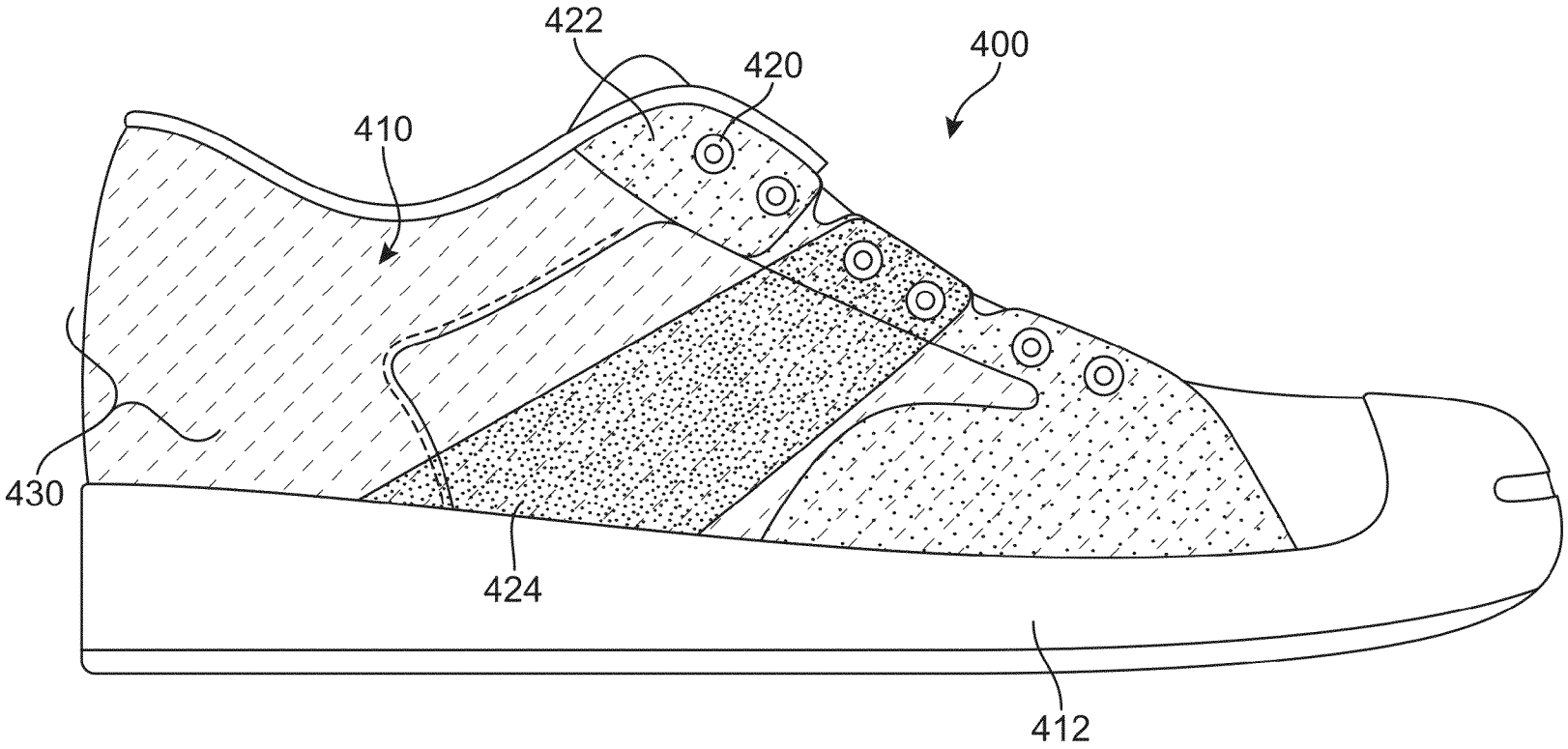
FIG. 21 is a side view of an article of footwear, according to an embodiment.
Figure 29:
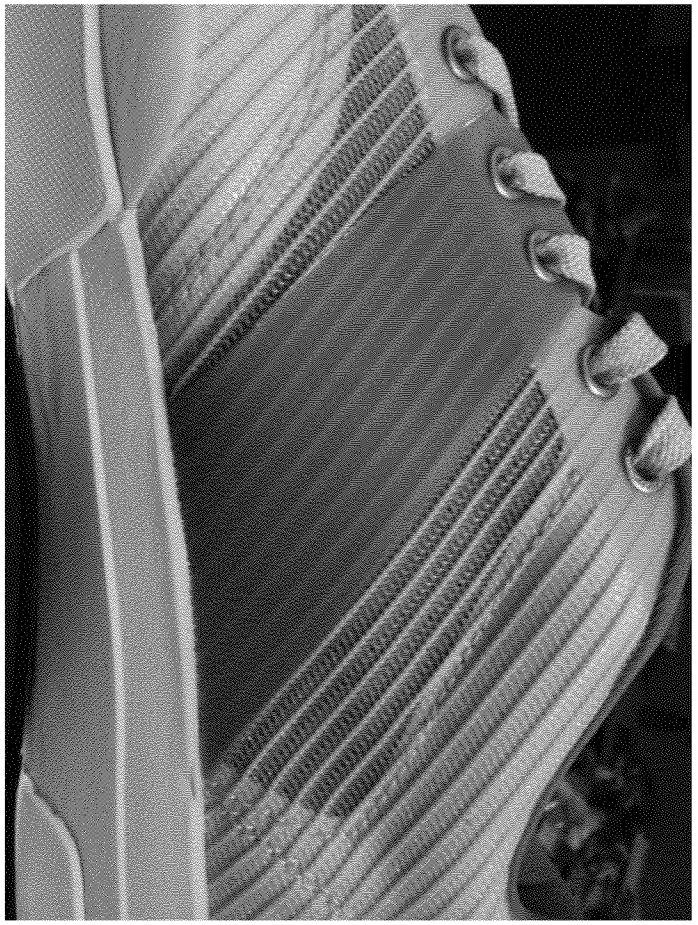
FIG. 29 is a picture of an article of footwear incorporating a mesh material having a seersucker pattern, according to an embodiment.

According to an embodiment, mesh material may be formed into a seersucker pattern. Such a seersucker pattern may be formed, for example, by a knitted mesh material. FIG. 21 shows an example of an article of footwear 400 which incorporates a mesh material 410 having a seersucker pattern. Mesh material 410 may include high tensile strength strands 430 that provide strength and stretch resistance to the mesh material 410. Mesh material 410 may have the characteristics of mesh materials discussed above. For example, mesh material 410 may be breathable and semi-transparent. As shown in the example of FIG. 21, the mesh material 410 may be incorporated so that the high tensile strength strands 430 are oriented at an angle between a sole structure 412 and a lace aperture 420, although other angles may be utilized, such as a substantially vertical angle between sole structure 412 and lace aperture 420. FIG. 29 is included to provide a picture of an article of footwear incorporating a mesh material having a seersucker pattern, according to an embodiment.

Figure 22:
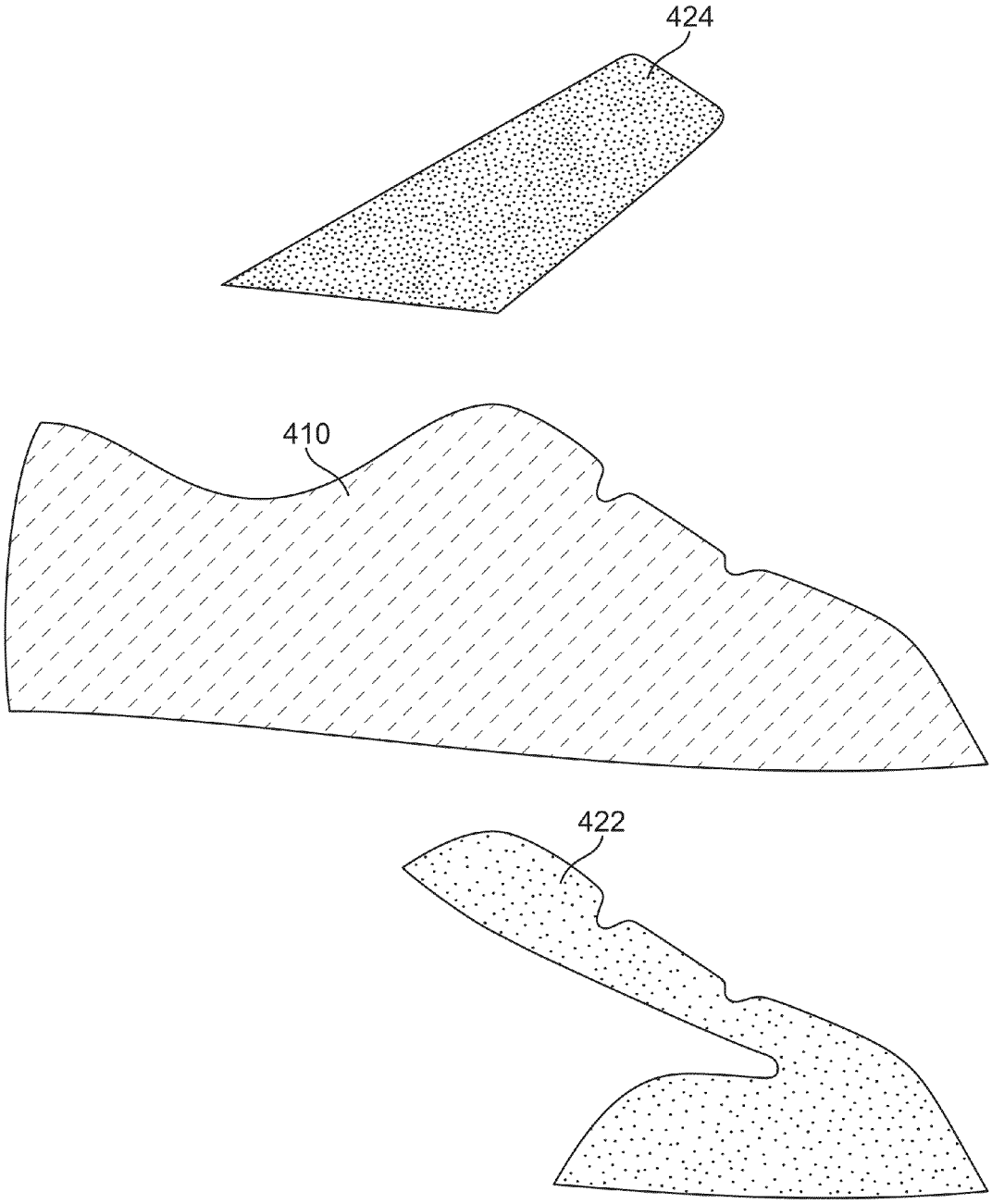
FIG. 22 is an exploded view of an article of footwear, according to an embodiment.

FIG. 22 shows an exploded view of the upper of article of footwear 400 in FIG. 21. As shown in the embodiment of FIG. 22, the upper may include a strap 424, mesh material 410, and a liner 422. Strap 424 may be provided to assist in securing upper to a foot and improve the feel of article of footwear 400. A liner 422 may also be provided. According to an embodiment, strap 424 and/or liner 422 may have a color and/or pattern which contributes to the design of mesh material 410. Although FIG. 22 depicts strap 424 as being on top of mesh material 410, strap 424 may be located underneath mesh material 410.

Figure 23:
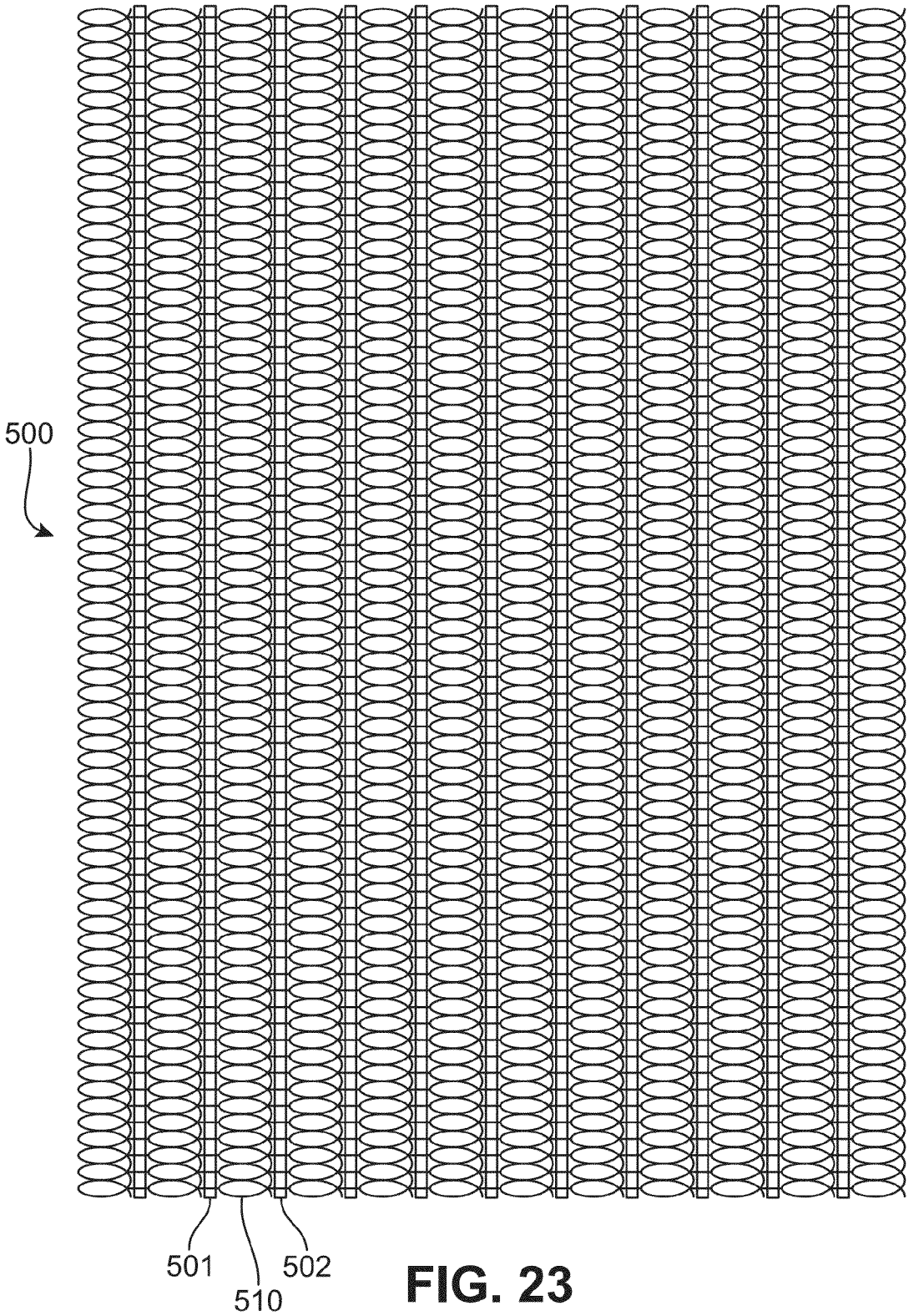
FIG. 23 is a view of a mesh material, according to an embodiment.

A mesh material in the form of a seersucker pattern may include high tensile strength strands and intersecting non-high tensile strength strands that interlock with the high tensile strength strands to provide a mesh structure that substantially holds the high tensile strength strands in place. Turning to FIG. 23, a mesh material 500 may be provided with a seersucker pattern that includes a first high tensile strength strand 501 and a second high tensile strength strand 502. Mesh material 500 may further include non-high tensile strength strands 510 in between first high tensile strength strand 501 and second high tensile strength strand 502 which connect first high tensile strength strand 501 and second high tensile strength strand 502 together. For example, non-high tensile strength strands 510 may have a knitted pattern that knits first high tensile strength strand 501 and second high tensile strength strand 502 together such as with, for example, knitted loops formed by non-high tensile strength strands 510.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear having a toe end, an opposite heel end to the toe end, a medial side, and an opposite lateral side to the medial side, the article of footwear comprising:

a sole structure; and an upper coupled with the sole structure, the upper comprised of a mesh material having a plurality of higher tensile strength strands and a plurality of lower tensile strength strands, the plurality of higher tensile strength strands having a relatively greater tensile strength than the plurality of lower tensile strength strands, the upper comprising a plurality of lace apertures, the plurality of higher tensile strength strands being positioned adjacent to and extending diagonally from the plurality of lace apertures to the sole structure, such that the plurality of higher tensile strength strands resist stretch due to tension caused by a lace engaged with the plurality of lace apertures, wherein the plurality of higher tensile strength strands and the plurality of the lower tensile strength strands interlock so that the plurality of higher tensile strength strands are substantially held in place.

2. The article of footwear according to claim 1, wherein the mesh material is a woven material.

3. The article of footwear according to claim 1, wherein the mesh material is a knitted material.

4. The article of footwear according to claim 1, wherein the mesh material has a plaid pattern.

5. The article of footwear according to claim 1, wherein the mesh material provides substantially an entire thickness of the upper.

6. An article of footwear, comprising:

a sole structure; and an upper including a mesh material, wherein the mesh material includes one or more sets of higher tensile strength strands and one or more sets of lower tensile strength strands, each higher tensile strength strand of the one or more sets higher tensile strength strands having a relatively greater tensile strength than each lower tensile strength strand of the one or more sets of lower tensile strength strands, wherein the one or more sets of higher tensile strength strands and the one or more sets of lower tensile strength strands interlock in a direction substantially perpendicular to a longitudinal axes of the one or more sets of higher tensile strength strands so that the one or more sets of lower tensile strength strands substantially hold the one or more sets of higher tensile strength strands in place, the upper further comprising;

a plurality of lace apertures incorporated into the mesh material of the upper; and at least a first set of higher tensile strength strands of the one or more sets of higher tensile strength strands that extend diagonally from at least a first lace aperture of the plurality of lace apertures to the sole structure, such that the at least the first set of higher tensile strength strands reinforce the upper against stretch between the at least the first lace aperture and the sole structure.

7. The article of footwear according to claim 6, wherein the mesh material is a woven material.

8. The article of footwear according to claim 6, wherein the mesh material provides substantially an entire thickness of the upper.

* * * * *